US012180706B2

(12) United States Patent
Perez Romero et al.

(10) Patent No.: US 12,180,706 B2
(45) **Date of Patent: *Dec. 31, 2024**

(54) ENGINEERED WOOD STRUCTURAL SYSTEM

(71) Applicant: PHYLEM STRUCTURES, S.L., Madrid (ES)

(72) Inventors: Manuel Perez Romero, Madrid (ES); Jaime Tarazona Lizarraga, Madrid (ES)

(73) Assignee: PHYLEM STRUCTURES, S.L., Madrid (ES)

( * ) Notice: Subject to any disclaimer, the term of this patent is extended or adjusted under 35 U.S.C. 154(b) by 0 days.

This patent is subject to a terminal disclaimer.

(21) Appl. No.: 18/500,698

(22) Filed: Nov. 2, 2023

(65) Prior Publication Data

US 2024/0060298 A1 Feb. 22, 2024

Related U.S. Application Data

(63) Continuation of application No. 17/613,810, filed as application No. PCT/EP2021/064872 on Jun. 2, 2021, now Pat. No. 11,846,100.

(30) Foreign Application Priority Data

Jun. 5, 2020 (EP) ..... 20382489

(51) Int. Cl.
*E04B 5/14* (2006.01)
*E04B 1/26* (2006.01)
(Continued)

(52) U.S. Cl.
CPC ..... *E04B 5/14* (2013.01); *E04B 1/2604* (2013.01); *E04C 3/292* (2013.01); *E04C 3/36* (2013.01);
(Continued)

(58) Field of Classification Search
CPC .... E04B 5/14; E04B 1/2604; E04B 2001/262; E04B 2001/264; E04B 2001/2672;
(Continued)

(56) References Cited

U.S. PATENT DOCUMENTS 3,866,371 A 2/1975 Falconer
4,089,144 A 5/1978 Astl
(Continued)

FOREIGN PATENT DOCUMENTS

EP 0079761 A1 5/1983
EP 0550803 A1 7/1993
(Continued)

OTHER PUBLICATIONS

International Search Report and Written Opinion for Corresponding International Application No. PCT/EP2021/064872 (13 Pages) (Aug. 18, 2021).

*Primary Examiner* — Rodney Mintz
(74) *Attorney, Agent, or Firm* — LUCAS & MERCANTI, LLP

(57) ABSTRACT

An engineered wood structural system including multiple vertical structural elements (10) and multiple horizontal structural elements (20, 120) wherein multiple horizontal structural elements (20, 120) of the same floor level are laterally adjacent slabs connected to each other through a perimetral region of the upper horizontal board of one slab attached to a perimetral region of the upper horizontal board of other laterally adjacent slab directly, through complementary staggered steps or through a joint connector, to transfer horizontal loads.

12 Claims, 25 Drawing Sheets

(51) Int. Cl.
*E04C 3/292* (2006.01)
*E04C 3/36* (2006.01)

(52) U.S. Cl.
CPC ... *E04B 2001/262* (2013.01); *E04B 2001/264* (2013.01); *E04B 2001/2672* (2013.01)

(58) Field of Classification Search
CPC ... E04B 5/12; E04B 1/26; E04C 3/292; E04C 3/36; E04C 3/127; E04C 3/14
See application file for complete search history.

(56) References Cited

U.S. PATENT DOCUMENTS

| | | | | |
|---|---|---|---|---|
| 4,227,358 | A | 10/1980 | Gat | |
| 5,031,371 | A * | 7/1991 | Davister | E04B 1/1909 52/236.1 |
| 9,181,701 | B2 | 11/2015 | Hofmann | |
| 10,174,497 | B2 | 1/2019 | Perez-Romero et al. | |
| 10,543,614 | B2 | 1/2020 | Perez-Romero et al. | |
| 10,858,822 | B2 | 12/2020 | Mori et al. | |
| 11,021,866 | B2 | 6/2021 | Mori et al. | |
| 11,846,100 | B2 * | 12/2023 | Perez Romero | E04C 3/292 |
| 2010/0275551 | A1 | 11/2010 | Hofmann | |
| 2016/0348368 | A1 | 12/2016 | Godfrey | |
| 2017/0370090 | A1 | 12/2017 | Perez-Romero et al. | |
| 2018/0229394 | A1 | 8/2018 | Perez-Romero et al. | |
| 2019/0145092 | A1 | 5/2019 | Mori et al. | |
| 2020/0123763 | A1 | 4/2020 | Mori et al. | |
| 2022/0112708 | A1 | 4/2022 | Bingler et al. | |
| 2023/0167638 | A1 | 6/2023 | Perez Romero et al. | |

FOREIGN PATENT DOCUMENTS

| | | | |
|---|---|---|---|
| FR | 2133487 | A1 | 12/1972 |
| FR | 2613403 | A1 | 10/1988 |
| WO | 2015011300 | A1 | 1/2015 |
| WO | 2015121886 | A1 | 8/2015 |
| WO | 2016191510 | A1 | 12/2016 |

* cited by examiner

ENGINEERED WOOD STRUCTURAL SYSTEM

CROSS REFERENCE TO RELATED APPLICATION

This Application is a Continuation Application of U.S. patent application Ser. No. 17/613,810 filed on Nov. 23, 2021 which in turn is a 371 of PCT/EP2021/064872 filed on Jun. 2, 2021, which claims the benefit of priority of European Patent Application No. 20382489.1 filed Jun. 5, 2020, each of which are incorporated herein by reference.

TECHNICAL FIELD

The present invention is directed to an engineered wood structural system for erecting structures made mostly or entirely with components made of engineered wood connected to each other, preferably through using durable moisture-resistant structural adhesives such as polyurethane or other resins.

STATE OF THE ART

The structural systems made of engineered wood are known in the state of the art.

For example, document WO2016191510A1 describe an engineered wood structural system comprising wall panels and horizontal structural elements in the shape of beams or slabs. Each beam includes an upper horizontal board, a lower horizontal board and a second spacer placed between and attached to the upper and lower horizontal boards. The slabs are constitutive of structural floor levels, each slab being supported on said beams and comprising an upper horizontal board and a lower horizontal board separated and connected through second spacers defined by first ribs and second ribs perpendicular to the first ribs. The wall panels have a construction similar to the slabs but including first seats on its upper end where second seats defined by the second spacer of the beams are engaged and supported, defining a structural node, transmitting vertical loads from the beams to the wall panels.

This solution permits the prefabrication and the subsequent assembly of the different constructive elements of the structural system.

The connection between the different constructive elements through the structural nodes proposed in this solution allows the transmission of vertical loads, for example from the beams to the wall panels, but prevents the structural continuity of the panel walls through the structural node and the transmission of bending loads therethrough.

Also, different horizontal structural elements converging on the same structural node are not connected to each other and can either transmit loads between them or compensate said loads between converging horizontal structural elements.

Furthermore, the proposed connections between the horizontal structural element and the wall panels are not rigid connections and therefore other loads different from the vertical loads, such shear loads, bending loads or twisting loads cannot be properly transmitted across the different constructive elements, and according to this solution, the vertical loads are transmitted through the wall panels, but the beams are stacked on top of said wall panels interrupting its vertical continuity, preventing the vertical transmission of loads through said wall panels when three or more structural floor levels are overlapped, supported on said wall panels. If the vertical loads cannot be continuously transmitted through the constructive elements intended to transmit the vertical loads, in this case the wall panels, the vertical loads supported by said constructive elements are reduced and the size, resistance and price of the structural system is negatively affected.

Document U.S. Pat. No. 3,866,371A also describe an engineered wood structural system including a vertical structural element, defined by a continuous upright, and horizontal structural elements in the shape of beams connected to the lateral sides of said vertical structural element for transferring loads between the converging beams allowing for the compensation of said loads, the vertical structural element crossing through an empty core of the beam.

Each beam is made of left and right boards facing each other defining in between the space through which the vertical structural element passes.

The vertical structural elements defined in this solution have a reduced resistance in front of bending forces.

Furthermore, in this case when beams in a first direction and in a second direction, for example first and second orthogonal directions, converge on the same vertical structural element the vertical connectors of the beams in the first direction interfere with and partially interrupt the vertical connectors of the beams in the second direction, and only halve of the total vertical high of each vertical connector is continuous across the structural node connecting with the opposite beam, negatively affecting the resistance of said vertical connector and reducing the load transmission between the connected beams. This solution only permits the connection between aligned beams, but not the proper load transmission of loads between non-aligned beams converging on the same vertical structural element.

Document US20100275551 describe a connection between two aligned portions of a beam through a finger joint on the facing end and through a lower connector adhered to a lower surface of said beams. In this case the lower connector is a triangular-shaped board fitted in a complementary recess. In this case the beams are solid squared beams, which are structurally inefficient and therefore expensive compared with other types of beams. This solution is also directed only to the obtention of a long longitude beam made of multiple partial beams glued together, but not to connection of said beams with a vertical structural element not to the transmission of loads between converging beams supported on a vertical structural element or the transmission of loads from said converging beams to the vertical structural element.

Document EP0550803A1 describe a connection system between aligned beams similar to the one described on document US20100275551. In this case the beams are also solid squared beams, and the connectors are integrated in recessed staggered steps of the beams. But in this document, when this solution is applied to the connection between converging beams and a vertical structural element, only vertical connectors made of vertical boards adhered to the lateral vertical surfaces of the beams and of the vertical structural element are suggested, transmitting bending loads through said vertical connectors and only allowing the connection between aligned beams but not the connection with beams converging from other different directions. As stated above the engineered wood is more efficient when transmitting compression of traction loads than when transmitting bending loads, therefore the vertical connectors suggested on this document are not the most efficient use of the engineered wood, negatively affecting the structural system efficiency. This document does not suggest vertical structural elements having continuity of vertical loads transmission when multiple overlapped structural floor levels are supported on the vertical structural elements.

Document EP0079761A1 describes a structural system including beams comprising an upper horizontal board and a lower horizontal board connected though a second spacer which ends are connected to vertical structural elements including a first seat where the second spacer is supported, but this document does not describe the connection between different beams converging on the same vertical structural element.

Document FR2613403A1 describe an engineered wood structural system including vertical structural elements made of four L-shaped vertical struts. Between said vertical struts vertical flat slats can be inserted and connected through a bolt, providing an articulated union. This solution does not allow the connection of several horizontal structural segments converging on the same structural node to each other to transmit traction and compression forces to each other.

Documents FR2133487A1, WO2015011300A1 and WO2015121886A1 also describe other engineered wood structural systems.

The present invention solves the above described and other problems.

BRIEF DESCRIPTION OF THE INVENTION

The present invention is directed to an engineered wood structural system made of engineered wood components.

It will be understood that the engineered wood are derivative wood products which are manufactured by binding or fixing strands, particles, fibers, veneers or boards of wood, wood chips, wood powder, or other vegetal products such bamboo, together with adhesives to form composite material. This type of wood is also known as mass timber, composite wood, man-made wood, or manufactured board.

The most common types of engineered wood are the plywood, which is manufactured from sheets of laminated veneer switching directions and bonded under heat and pressure with durable moisture-resistant adhesives, the laminated veneer lumber (LVL), which is similar to plywood but with the veneers all stack in the same direction, the oriented strand board (OSB) manufactured from wood flakes oriented in multiple directions compressed and glued together, the laminated strand lumber (LSL), which is similar to OSB but with the strands all stack in the same direction, and the medium-density fiberboard manufactured from wood fibers or sawdust compressed and glued together. Other types of engineered wood products are commonly known as Glulam, mass timber (EWP) and cross-laminated timber (CLT).

The aim of the present invention is to describe a structural system using engineered wood as a main structural component not only of the structural elements but also of the connections between those structural elements.

Preferably, the engineered wood used in the present invention in the main engineered wood components, or at least for the engineered wood components supporting higher loads, have a maximal compressive strength comprised between 20 to 40 N/mm2 (between 2900.75 and 5801.51 psi) and/or a maximal shear strength up to 8 N/mm2 (1160.3 psi), and the adhesives used preferably have, once hardened, a maximal compressive strength equal or higher than the compressive strength of the attached engineered wood components and a maximal shear strength equal or higher than the shear strength of the attached engineered wood components.

The structural system includes the following components, which are already known in the state of the art:

- at least one vertical structural element with several structural nodes on different vertical positions, corresponding to different floor levels, each structural node including at least one first seat;
- at least one horizontal structural element for each structural node, each horizontal structural element made up of an upper horizontal board and a lower horizontal board facing each other, separated to each other in a vertical direction and rigidly connected to each other through second spacers comprised between said upper and lower horizontal boards, the at least one horizontal structural element including at least one second seat supported and vertically overlapped on the at least one first seat of the vertical structural element.

Several parallel vertical structural elements, i.e. several parallel pillars, can be connected to each other through said horizontal structural elements defining a structure with several overlapped structural floor levels.

Each horizontal structural element comprises an upper horizontal board and a lower horizontal board facing each other and separated a distance. The upper horizontal board and the lower horizontal board of each horizontal structural element are rigidly attached to each other through at least one second spacer, transferring shear forces between said upper and lower horizontal boards, increasing the resistance of the horizontal structural element, producing a resistant, light, and cheap horizontal structural element.

It will be understood that the word board is referred to a flat sheet of material which determine two main surfaces with the biggest surface area of the board, four perimeter surfaces connecting said two main surfaces.

The longitude of the board will be the longest measure of the main surface, the width of the board will be the measure of the main surface perpendicular to the longitude, and the thickness will be the measure orthogonal to the longitude and the width.

It will be also understood that the reference to the horizontal or vertical position of the boards or slats is referred to the position of the main surfaces thereof, so a horizontal board is a board which main surfaces are in a mostly horizontal position. When the element is a complex structural element, such a vertical structural element or a horizontal structural element, the reference to the horizontal or vertical direction thereof is referred to the direction of its main longitude.

The first and second seats are preferably mostly flat and horizontal surfaces facing each other, providing a wide contact area between the first and second seats to spread the vertical loads transmitted from the horizontal structural element to the vertical structural element, preferably said contact area is of at least several square centimeters, for example above 10 cm2 or above 15 cm2 when the distance between vertical structural elements is of at least 3 m. Preferably, both first and second seats are made of engineered wood.

Preferably the second seat is not defined by a through hole on the horizontal structural element, but by a surface exposed downwards, not facing other surfaces of the same horizontal structural element, because a through hole reduces the resistance of the horizontal structural element on the most stressed area and makes more difficult the installation process.

The second seat can be, for example, a region, or a reinforced region, of the lower horizontal board, or a portion, or a reinforced region, of the second spacer non-covered by the lower horizontal board and/or a portion, or a reinforced portion, of the upper board extended in cantilever from the rest of the horizontal structural element.

The second seat can be supported on the first seat directly or through an interposed element such as an engineered wood, metal or plastic interposed element.

The reinforced region is a region including more resistant second spacers, or more densely populated second spacers, than the rest of the horizontal structural element and preferably a region where the second spacers completely fill the space between the horizontal lower and upper boards, preferably with engineered wood.

The horizontal structural element can further include reinforcements in other areas where the loads are accumulated or where the loads are bigger than in other areas. On those areas the reinforcement can be obtained by using thicker or more robust material or including an added reinforcement layer of material in the upper or lower horizontal boards and/or in the ribs constitutive of the second spacers. This can be particularly beneficial in areas where the bending forces are the highest, for example in a central region of a horizontal structural element supported between two or four structural nodes, or near said structural nodes.

Said second seat will be directly supported on the first seat transferring the vertical loads. The reinforced region can be, for example, a region of the lower horizontal board or of the second spacer with an increased thickness or made of a more resistant material or a more resistant engineered wood than other regions of the same element.

Preferably the upper horizontal board, the lower horizontal board, and optionally also the second spacers, are made of engineered wood, and it is also proposed to connect those elements with adhesives.

Preferably, the attachment between the different elements constitutive of the proposed structural system will be achieved through adhesives, or through adhesives in combination with nails or screws. The adhesives spread the transmitted loads through a wide attachment area, avoiding load concentrations which could produce a local damage in the engineered wood elements, typically produced when the attachment is produced only through a small number of screws or nails.

Preferably the adhesives used are durable moisture-resistant structural adhesives such as polyurethane or other resins, for example epoxy resins.

Due to the orthotropic nature of wood, the engineered wood slats, struts and boards are typically more resistant in a direction parallel to the main surface or the main longitude of said element than in a direction perpendicular to said main surface or main longitude.

In the case of Plywood with the veneers stuck in perpendicular directions, the resistance difference between X and Y is balanced.

When the loads transmitted from the horizontal structural element to the first seats are under certain threshold, the horizontal structural element can be supported on the first seats through a second seat defined in the lower horizontal board, compressing said lower horizontal board in a direction perpendicular to the main surface thereof. When the loads transmitted from the horizontal structural element to the first seat are above said certain threshold, then the second seat will be preferably defined on said second spacers, which may for example include a protruding downward projection through the thickness of the lower horizontal board, or a portion of the second spacer accessible through a region non covered by the lower horizontal board.

The vertical struts constitutive of the vertical structural element are rigidly connected to each other through interposed first spacers which keep the vertical struts spaced apart to each other and transmitting shear forces to each other, increasing the overall resistance of the vertical structural element.

The vertical struts are preferably made of engineered wood and can have a square or rectangular cross-section.

Preferably the vertical struts, and optionally also the first spacers and/or the first seat, are made of engineered wood, and it is also proposed to connect those elements with adhesives.

The first seat can be comprised between, and attached to, vertical surfaces of two vertical struts facing each other, said first seat including an upward facing surface where the second seat is supported through a downward surface thereof.

This construction concentrates the solid parts of the vertical structural element in the perimeter thereof, where it provides more resistance in front of bending forces, producing a rigid vertical structural element with a low mass and low cost, and producing a hollow interior of the vertical structural element.

A region of the horizontal structural element including a second seat is inserted in the hollow interior of the vertical structural element, between two vertical struts facing each other, without interrupting the vertical continuity of said vertical struts.

Said second seat is supported on a first seat at least partially comprised in the hollow interior of the vertical structural element, between the vertical struts, transmitting vertical loads from the horizontal structural element to the vertical structural element.

Each vertical structural element will receive the vertical loads from all the horizontal structural elements attached thereto, accumulating vertical loads from multiple structure floors.

Typically, each vertical structural element is connected with a foundation on its lower end which spreads and transmits all the vertical loads of the vertical structural element in a wider area of the terrain where the structure is placed.

According to an embodiment, the structural system comprises multiple vertical structural elements parallel to each other, each including first seats. Multiple horizontal structural elements are connected to said vertical structural elements through the first seats, each connection defining a structural node. Preferably slab members are supported on said horizontal structural elements defining several overlapped structure floors on different floor levels.

Each of said multiple horizontal structural elements has a portion comprised between at least two facing vertical struts and vertically supported on said first seats comprised between said two facing vertical struts. Preferably each vertical strut is made up of multiple successive vertical strut segments, made of a vertical sheet of engineered wood, aligned and rigidly connected to each other through a vertical connector, made of a vertical sheet of engineered wood, adhered to a vertical pillar surfaces of adjacent successive vertical strut segments or through complementary recessed staggered steps defined on adjacent end portion of two successive vertical strut segments overlapped and adhered to each other.

According to an embodiment of the present invention, the at least one vertical structural element includes at least one intermediate structural node in an intermediate portion thereof crossed by the vertical struts without interruption of the vertical struts, the vertical structural element extending above and below the intermediate structural node.

According to that, the structural nodes can be placed in intermediate positions of the vertical structural element, and not only in extreme positions, maintaining the structural continuity of the vertical struts above and below the structural node, transmitting not only vertical loads, but also bending loads, shear loads and twisting loads through said structural node of the vertical structural element.

It is also proposed that at least one structural node is crossed by the at least one horizontal structural element without interruption of said horizontal structural element and without interruption of said vertical struts, the horizontal structural element including portions projecting from the vertical structural element on at least two different sides of the vertical structural element, which can be opposed sides of the vertical structural element, such left and right sides, or two consecutive sides, such front and left sides, and preferably three or four sides of the vertical structural element.

According to that, at least one horizontal structural element passes through the structural node without interruption, transmitting loads from one projection to the other through said structural node, increasing the structural performance of the horizontal structural element.

The successive vertical strut segments cited above are rigidly connected to each other, for example, through:

- end surfaces of the successive vertical strut segments attached each other through adhesive;
- a vertical connector; or
- a vertical connector partially overlapped to both successive vertical strut segments and attached thereto; or
- a vertical connector partially overlapped to both successive vertical strut segments through complementary recessed staggered steps and attached thereto; or
- a vertical connector comprised between both successive vertical strut segments and connected to a first spacers rigidly attached to the successive vertical strut segments; or
- complementary recessed staggered steps defined on an end portion of the two successive vertical strut segments overlapped and attached to each other.

According to that, the connection between the vertical strut segments can be achieved by a vertical connector adhered simultaneously to end portions of two consecutive vertical strut segments of the same vertical strut and/or connected to a first spacer connected simultaneously to end portions of the two consecutive vertical strut segments. In some cases, the first spacer can also make the function of the vertical connector. In any case, the connection between successive vertical strut segments shall be a rigid connection. Said vertical connector can be made of a vertical sheet of engineered wood, metal, and/or carbon fiber.

Alternatively, the connection between the vertical strut segments can be achieved by the direct adhesion of two overlapped portions of the successive vertical strut segments connected to each other, said overlapped portions including complementary recessed staggered steps, defining an attachment portion. Each recessed staggered step is defined in a vertical plane parallel to the main surface of the vertical strut, increasing the attachment area where adhesives attach both connected elements.

Preferably each vertical strut segment is comprised between two structural nodes, said attachment between the successive vertical strut segments being produced in the portion of the vertical structural element defining the structural node.

It is also proposed that at least some of the vertical connectors can include one or more recessed staggered steps complementary and attached to recessed staggered steps included in the successive vertical strut segments connected to each other through said vertical connector. This connection offers a more even distribution of the loads, increases the connection surface, offers not only vertical connection surfaces but also horizontal connection surfaces on each step, and increases the strength of the connection. While the vertical surfaces ensure de connection between elements, the horizontal surfaces can transmit compression loads.

This connection also allows the two successive vertical strut segments and the vertical connector to be flush, when the two successive vertical strut segments have the same cross section area.

The successive strut segments can have all the same sectional area or preferably can have different sectional area adapted to the vertical loads supported by each strut segment. Closer to the foundation the strut segments support bigger vertical loads in comparison with the strut segments closer to the uppermost structure floor therefore, it is proposed to use always a strut segments with equal or smaller sectional area than the strut segments of the same vertical structural element placed bellow.

Multiple horizontal structural elements can be supported on the same structural node, each horizontal structural element including at least one second seat supported on the at least one first seat of the structural node.

In this case the horizontal structural elements supported on the same structural node will be rigidly connected to each other through an upper connector and/or through a lower connector.

The upper connector is at least partially contained in the hollow interior of the vertical structural element, at least partially overlapped, and attached, to all the horizontal structural elements supported in said structural node to transfer horizontal traction loads between the upper horizontal boards of the connected horizontal structural elements. Preferably, the upper connector is overlapped to an end portion of all the converging horizontal structural elements and is adhered to the upper horizontal board of the converging horizontal structural elements.

The lower connector is at least partially contained in the hollow interior of the vertical structural element, placed between the converging horizontal structural elements and in direct contact therewith, in contact therewith through interposed hardened adhesive and/or at least partially overlapped by, and attached to, all the horizontal structural elements supported in said structural node and/or at least partially overlapped by, and attached to, the second seats of all the horizontal structural elements supported in said structural node to transfer horizontal compression loads between the lower horizontal boards of the connected horizontal structural elements.

The lower connector can be made of engineered wood, metal, or can be a solid block of hardened adhesive.

For example, the lower connector can be placed between the converging horizontal structural elements and in close contact with them to transfer horizontal compression loads between them, for example as a block or as an inverted frustoconical shape fitted in between the facing ends of the converging horizontal structural elements, so that said lower connector can be compressed between said facing ends. It will be considered that the close contact can be produced through an interposed hardened adhesive.

The lower connector can be also at least partially overlapped to all the horizontal structural elements supported in said structural node, below them and attached thereto, to transfer horizontal compression loads between them, similar to the upper connector.

The lower connector can be also the first seat of the vertical structural element, when said first seat is simultaneously attached to all the second seats of all the horizontal structural elements supported on the same structural node, transferring horizontal compression loads between said converging horizontal structural elements.

The upper connector and/or the lower connector can include, for example, several radial horizontal connector arms surrounding a central portion contained in said hollow interior of the vertical structural element, each radial horizontal connector arm being connected to one horizontal structural element, or each radial horizontal connector arm being attached to one horizontal structural element through complementary recessed staggered steps.

The upper connector and/or the lower connector can be made, for example, of engineered wood, metal and/or carbon fiber.

When the upper or lower connectors include several radial horizontal connector arms and are made of engineered wood, said connector will preferably include several overlapped layers of engineered wood with different veneer orientation glued together.

The horizontal structural element can be, for example, a beam, or an I-shaped beam, with a region including the at least one second seat inserted in the hollow interior of the vertical structural element on each structural node supporting said beam or I-shaped beam.

The beam, or the I-shaped beam, can be a beam passing through the structural node, with the second seat defined in an intermediate region of the beam inserted in the hollow interior of the vertical structural element. Said beam can pass through several aligned structural nodes of different vertical structural elements, the beam having several second seats defined in several intermediate regions inserted in the hollow interior of the different vertical structural elements. A beam supported on a succession of aligned vertical structural elements close to each other, for example closer than 1 m or closer than 0.5 m, can be considered as an structural wall, specially if the spaces between the succession of aligned vertical structural elements are closed with a vertical wall panel.

The i-shaped beams provide an optimal use of material because the beams having an i-shape are strong and resistant using less volume of material than other types of beams and therefore, being lighter and cheaper.

Preferably the second spacer of the beams or the I-shaped beams is one or several central vertical boards, it is to say, slats with its main surfaces placed in a vertical position, connecting the upper horizontal board and a lower horizontal board, which have their main surfaces mostly in the horizontal position.

Alternatively, the second spacer of the beams or the I-shaped beams can be made, for example, of overlapped horizontal slats such several piled horizontal boards and/or several piled horizontal boards with oriented fibers parallel to each other and/or several piled horizontal boards with oriented fibers distributed in perpendicular directions in successive board, or can be alternatively made by triangulated bars of engineered wood or metal.

The beam, or the I-shaped beam, can be a post-stressed beam including at least one post-stressed cable between two opposed ends thereof. Alternatively, multiple aligned consecutive beams can be post-stressed beams including at least one continuous post-stressed cable passing along all said consecutive beams.

The opposed ends of said at least one beam will retain the at least one post-stressed cable in an upper position adjacent to the upper horizontal board and a central region of said at least one beam, placed between said opposed ends, retaining the at least one post-stressed cable in a lower position adjacent to the lower horizontal board.

According to this solution said post-stressed cable covers the entire longitude of the beam from one end to the opposed end, said post-stressed cable being retained in tension defining a polygonal or an arched shape, with the central region of the post-stressed cable being adjacent to a central region of the lower horizontal board of the beam and the two opposed ends of the post-stressed cable being adjacent to the end portions of the upper horizontal board of the beam, increasing the overall load resistance of the beam.

Optionally multiple consecutive beams are post-stressed beams including at least one continuous post-stressed cable passing along all said consecutive beams, the opposed ends of each beam retaining the at least one post-stressed cable in an upper position adjacent to the upper horizontal board and a central region of each beam, placed between said opposed ends thereof, retaining the at least one post-stressed cable in a lower position adjacent to the lower horizontal board, permitting the post-tensioning of multiple successive beams using the same post-stressed cable.

Alternatively said multiple consecutive beams are post-stressed beams each including at least one cable sleeve, the opposed ends of each beam retaining the at least one cable sleeve in an upper position adjacent to the upper horizontal board and a central region of each beam, placed between said opposed ends thereof, retaining the at least one cable sleeve in a lower position adjacent to the lower horizontal board, wherein each cable sleeve of each beam is connected with a cable sleeve of a successive beam of said consecutive beams through a sleeve connector, and wherein said multiple consecutive beams include at least one continuous post-stressed cable passing along all said consecutive beams through the respective cable sleeves which are connected to each other by said sleeve connectors.

In this manner the cable sleeve can be pre-installed on each beam and once the beams are installed, said cable sleeves can be connected to each other through the sleeve connectors and the post-stressed cable can be then inserted through said cable sleeves and post-tensioned.

Alternatively, the horizontal structural element can be a slab with a region including the at least one second seat inserted in the hollow interior of the vertical structural element, on each structural node supporting said slab, the slab including at least one vertical through hole adjacent to said second seat through which one vertical strut of the vertical structural element passes through the slab.

The slab can be simultaneously supported on several structural nodes of different vertical structural elements, the slab including a portion, with at least one second seat, inserted in the hollow interior of each vertical structural element. The slab will include at least one vertical through hole adjacent to each second seat, each vertical through hole being crossed by one vertical strut of the vertical structural elements.

In this case, the second spacers can include one or several central vertical boards or several central vertical boards arranged in orthogonal directions and/or a rigid foam rigidly connecting the upper and lower horizontal boards. The central vertical boards are boards having its main surfaces in vertical direction. Alternatively, those second spacers can be also piled horizontal boards in one direction or in two orthogonal directions.

According to an embodiment, the slab can be a post-stressed slab including multiple slab post-stressed cables parallel to each other or disposed in two crossed directions.

Alternatively, multiple aligned consecutive slabs can be post-stressed slabs including multiple continuous slab post-stressed cables parallel to each other or disposed in two crossed directions, at least some of said slab post-stressed cables passing along all said consecutive slabs.

Preferably, in at least one structural node, the upper and lower horizontal boards, of at least one horizontal structural element connected to said structural node, are separated from the vertical struts of the vertical structural element by a gap distance, and the first and second seats are configured to reduce or avoid the transmission of bending forces, defining an articulated joint between the horizontal structural element and the vertical structural element. In this case, the vertical loads are transmitted from the horizontal structural element to the vertical structural element through the second seat being overlapped and supported on the first seat of the vertical structural element, but not providing a rigid attachment and thus avoiding the transmission of bending forces.

When the horizontal structural elements are attached to upper and lower connectors, said upper and lower connectors will be also separated from the vertical struts by said gap distance, avoiding the transmission of bending forces therethrough.

The skilled person will be perfectly aware of many different connections which will avoid the transmission of bending forces. For example, to avoid the transmission of bending forces, the first and second seats provide transmission of forces in the vertical descending direction but prevent or prevent the transmission of forces in vertical ascending direction or in the horizontal directions completely or mostly.

Alternatively, in at least one structural node, the upper and lower horizontal boards, of the at least one horizontal structural element connected to said structural node, are respectively connected to opposed vertical sides of the vertical struts, transmitting bending forces to the vertical struts defining a rigid joint between the horizontal structural element and the vertical structural element. Said connection can be produced directly or through the upper and/or lower connectors and/or through hardened adhesives filling said gap distance.

When the horizontal structural elements are attached to upper and lower connectors, said upper and lower connectors can be also connected to opposed vertical sides of the vertical struts, transmitting a pair of opposed horizontal forces, transmitting a bending force to the vertical structural element.

In this case, the lower horizontal board, or the lower connector attached to said lower horizontal board, will be compressed against a vertical side of one or several vertical struts of the vertical structural element, transmitting an horizontal compression force thereto, and the upper horizontal board, or the upper connector attached to said upper horizontal board, will be compressed against another vertical side of one or several vertical struts, said vertical side being opposed to the previously mentioned vertical side connected to the lower horizontal board, transmitting an horizontal compression force thereto opposed and above the previously mentioned horizontal compression force. Said pair of opposed horizontal forces transmit a bending force to the vertical struts, producing a rigid attachment between the horizontal structural element and the vertical structural element.

In this case, the first and second seats can be configured to avoid the transmission of bending forces or to also transmit bending forces.

According to some examples of this embodiment, the said opposed vertical sides receiving the horizontal compression forces are vertical sides facing each other in the hollow interior of the vertical structural element, being vertical sides of two different vertical struts, or are opposed vertical sides of the same vertical struts, or are vertical sides of different vertical struts, said vertical sides being in the external perimeter of the vertical structural element.

According to one embodiment, at least one horizontal structural element can be simultaneously supported on several structural nodes of different vertical structural elements.

Horizontal structural elements of the same floor level can be laterally adjacent slabs. Those adjacent slabs can be connected to each other, for example, through the attachment of:

- a perimetral region of the upper horizontal board of one slab attached to a perimetral region of the upper horizontal board of other laterally adjacent slab directly, one on top of the other, through complementary staggered steps or through an interposed joint connector, to transfer horizontal loads; and/or
- a perimetral region of the upper horizontal board of one slab attached to a perimetral region of the upper horizontal board of other laterally adjacent slab directly, one on top of the other, through complementary staggered steps or through an interposed joint connector, to transfer horizontal traction loads, and a perimetral region of the lower horizontal board of one slab attached, to a perimetral region of the lower horizontal board of the other laterally adjacent slab to transfer horizontal loads.

According to that, different horizontal structural elements of the same floor level, typically different slabs, can be laterally attached to each other producing a continuous floor level. The attachment between adjacent horizontal structural elements provides a structural continuity increasing the performance of the horizontal structural elements thanks to the load transmission between them. When the horizontal structural elements are slabs, the connection can be produced directly through perimetral regions of said adjacent slabs or through a joint connector connecting said adjacent slabs.

The slab can be connected to adjacent slabs only through perimetral regions of two opposed ends thereof, obtaining a slab with unidirectional structural continuity with adjacent slabs. Alternatively, the slab can be connected to adjacent slabs through perimetral regions of four sides of the slab, obtaining a bidirectional structural continuity with adjacent slabs.

Regardless of whether the horizontal structural elements are slabs or beams, an additional embodiment is proposed, which can be implemented independently from the previous embodiments described above, (i.e. with a vertical structural elements different than the ones described above or with a connection between the horizontal structural elements and the vertical structural elements different than the connections described above), or which can be freely combined with any of the proposed embodiments, providing different solutions which could be base for divisional applications.

The present embodiment is directed towards an engineered wood structural system made of engineered wood components including:

several horizontal structural elements separated by a gap distance, each horizontal structural element including at least one second seat supported and vertically overlapped on at least one first seat of one vertical structural element, each horizontal structural element being made up of an upper horizontal board and a lower horizontal board facing each other, separated to each other in a vertical direction and rigidly connected to each other through second spacers comprised between said upper and lower horizontal boards;

at least one slab segment placed between, and supported on, the horizontal structural elements covering the gap distance between them and defining the floor level, the slab segment being made up of an upper horizontal board and a lower horizontal board facing each other, separated to each other in a vertical direction and rigidly connected to each other through third spacers comprised between said upper and lower horizontal boards.

The third spacers may have the same possible embodiments than the second spacers described above.

The at least one slab segment can be supported on the horizontal structural elements through a third seat included in said slab segment. Said third seat can be:

a perimetral region of the upper horizontal board of the slab segment attached to the upper horizontal board of the surrounding horizontal structural elements directly, through complementary staggered steps or through a joint connector to transfer horizontal traction loads; and/or a perimetral region of the upper horizontal board of the slab segment attached to the upper horizontal board of the surrounding horizontal structural elements directly, through complementary staggered steps or through a joint connector to transfer horizontal traction loads, and a perimetral region of the lower horizontal board of the slab segment attached to a perimetral region of the lower horizontal board of the surrounding horizontal structural elements, directly, through complementary staggered steps or through an interposed connector, to transfer horizontal compression loads; and/or a perimetral region of the upper horizontal board of the slab segment attached to the upper horizontal board of other adjacent slab segment directly, through complementary staggered steps or through a joint connector to transfer horizontal traction loads, the slab segment being supported on at least one horizontal structural element;

a perimetral region of the upper horizontal board of the slab segment attached to the upper horizontal board of other adjacent slab segment directly, through complementary staggered steps or through a joint connector to transfer horizontal traction loads, the slab segment being supported on at least one horizontal structural element, and a perimetral region of the lower horizontal board of the slab segment attached to a perimetral region of the lower horizontal board of the adjacent slab segments, directly, through complementary staggered steps or through an interposed connector, to transfer horizontal compression loads.

Each slab segment can be connected to the horizontal structural element through third seats vertically overlapped and attached to the horizontal structural elements. The third seat can be, for example, a region or a reinforced region of the lower horizontal board of the slab segment, or a downward exposed surface of the slab segment, such an exposed portion of the third spacers, overlapped, and attached, to the upper horizontal board of the at least one horizontal structural element or to an upward exposed surface of the horizontal structural element.

When the horizontal structural elements are slabs, said upper horizontal board of the interposed slab segments can be flush with the upper horizontal board of said slabs. The connection can be produced through a partially overlapped perimetral region of the interconnected slabs, through staggered steps for example.

The slab segment can be connected to adjacent slabs only through perimetral regions of two opposed ends thereof, obtaining a slab segment with unidirectional structural continuity with adjacent slabs. Alternatively, the slab segment can be connected to adjacent slabs through perimetral regions of four sides of the slab segment, obtaining a bidirectional structural continuity of the slab segment with adjacent slabs.

When the horizontal structural elements are beams, the upper horizontal board of the interposed slab segments can be overlapped on, and attached to, the upper horizontal board of the beam, and preferably the upper horizontal boards of adjacent slab segments placed on opposed sides of the same beam can be connected to each other, transferring traction loads between the adjacent slab segments.

In this case, the slab segment can be connected to adjacent slab segments only through perimetral regions of two opposed ends thereof, obtaining a slab segment with unidirectional structural continuity with adjacent slab segments. Alternatively, the slab segment can be connected to adjacent slab segments through perimetral regions of four sides of the slab segment, obtaining a bidirectional structural continuity of the slab segment with adjacent slab segments.

The upper horizontal board of the slab segment is connected to the upper horizontal board of an adjacent slab segment directly, through complementary overlapped staggered steps provided in the perimetral zone of the upper horizontal boards or through connectors, to transfer horizontal traction loads between them and/or the lower horizontal board of the slab segment is connected to the lower horizontal board of an adjacent slab segment directly, through complementary overlapped staggered steps provided in the perimetral zone of the lower horizontal boards or through connectors, to transfer horizontal compression loads between them.

The slab segment can be supported on the upper horizontal board of the horizontal structural element through the third seats defined in the downward facing surface of the upper horizontal board of the slab segment, and/or on the lower horizontal board of the horizontal structural element through the third seats, and/or on the second spacers of the horizontal structural element.

When the slab segment is supported on beams, the slab segment can be placed above the beam, with the third seats defined in the lower horizontal board of the slab segment or in the third spacers, said third seats being supported on, and attached to, the upper horizontal board of the beam.

Alternatively, the beam can be at least partially embedded in the structural floor level, reducing the overall thickness, and the adjacent slab segments placed on opposed sides of the beam can be connected to each other directly, through complementary overlapped staggered steps provided in the perimetral zone of the upper horizontal boards or through connectors, to transfer horizontal traction loads between them. The lower horizontal board of the slab segment can also be connected to the lower horizontal board of the adjacent slab segment directly, through complementary overlapped staggered steps provided in the perimetral zone of the lower horizontal boards or through connectors, to transfer horizontal compression loads between them. Said connectors can be integrated in the beam or can pass through said beam.

The construction of the beams, of the slabs, of the slab segments, and its connection through the perimetral region can be implemented independently of the connection of the horizontal structural elements with the vertical structural element, therefore such features can be basis for a divisional application.

Preferably, the vertical structural element has a square or rectangular cross-section defined by two vertical struts each covering two corners of the vertical structural element defining two entrances for the hollow interior of the structural node. Two different horizontal structural elements can be inserted on the hollow interior through said entrances, or one single horizontal structural element can pass through the hollow interior protruding through said two entrances.

Alternatively, the vertical structural element is defined by three vertical struts, one vertical strut covering two corners of the vertical structural element and the other two vertical struts placed on the remaining two corners of the vertical structural element, defining three entrances for the hollow interior of the structural node.

Optionally, the vertical structural element is defined by four vertical struts placed on four corners of the vertical structural element defining four entrances for the hollow interior of the structural node.

Some engineered wood elements connected to each other may have a tolerance gap between them, or a tolerance gap of up to 25 mm (0.984 in) between them filled with hardened adhesive when no shear loads are transmitted through said hardened adhesive, or a tolerance gap of up to 1 mm (0.039 in) between them filled with hardened adhesive when shear loads are transmitted through said hardened adhesive.

It will be understood that references to geometric position, such as parallel, perpendicular, tangent, etc. allow deviations up to ±5° from the theoretical position defined by this nomenclature. Other features of the invention appear from the following detailed description of an embodiment.

BRIEF DESCRIPTION OF THE FIGURES

The foregoing and other advantages and features will be more fully understood from the following detailed description of an embodiment with reference to the accompanying drawings, to be taken in an illustrative and non-limitative manner, in which.

On the drawings a shading has been added on the surfaces where adhesive is applied.

DETAILED DESCRIPTION OF AN EMBODIMENT

The foregoing and other advantages and features will be more fully understood from the following detailed description of an embodiment with reference to the accompanying drawings, to be taken in an illustrative and not limitative.

According to one embodiment, the engineered wood structural system of the present invention can be used to erect a multi-floor building with multiple stacked structural floor levels, for example, between five and twenty structural floor levels, wherein each vertical structural element 10 is an isolated vertical structural element connected with two, three or four horizontal structural elements 120, 20, in the form of beams 20, converging on a structural node of said vertical structural element 10 for each structural floor level. In those buildings, the structural nodes are preferably rigid nodes connecting the beams and the vertical structural elements. Similarly, the horizontal structural element can be one or several slabs 120 connected to the structural node of the vertical structural element 10.

Alternatively, the building can include rigid elements covering the entire height of the building, such a rigid core (typically the staircase or the elevator enclosure) or diagonal elements connecting some structural nodes of different levels.

The proposed engineered wood structural system can also be used to erect a multi-floor building with structural walls, for example a balloon or platform frame building, where said structural walls are made of a succession of parallel aligned vertical structural elements supporting one continuous horizontal structural element, in the form of a beam or of a slab.

Figure 1A:
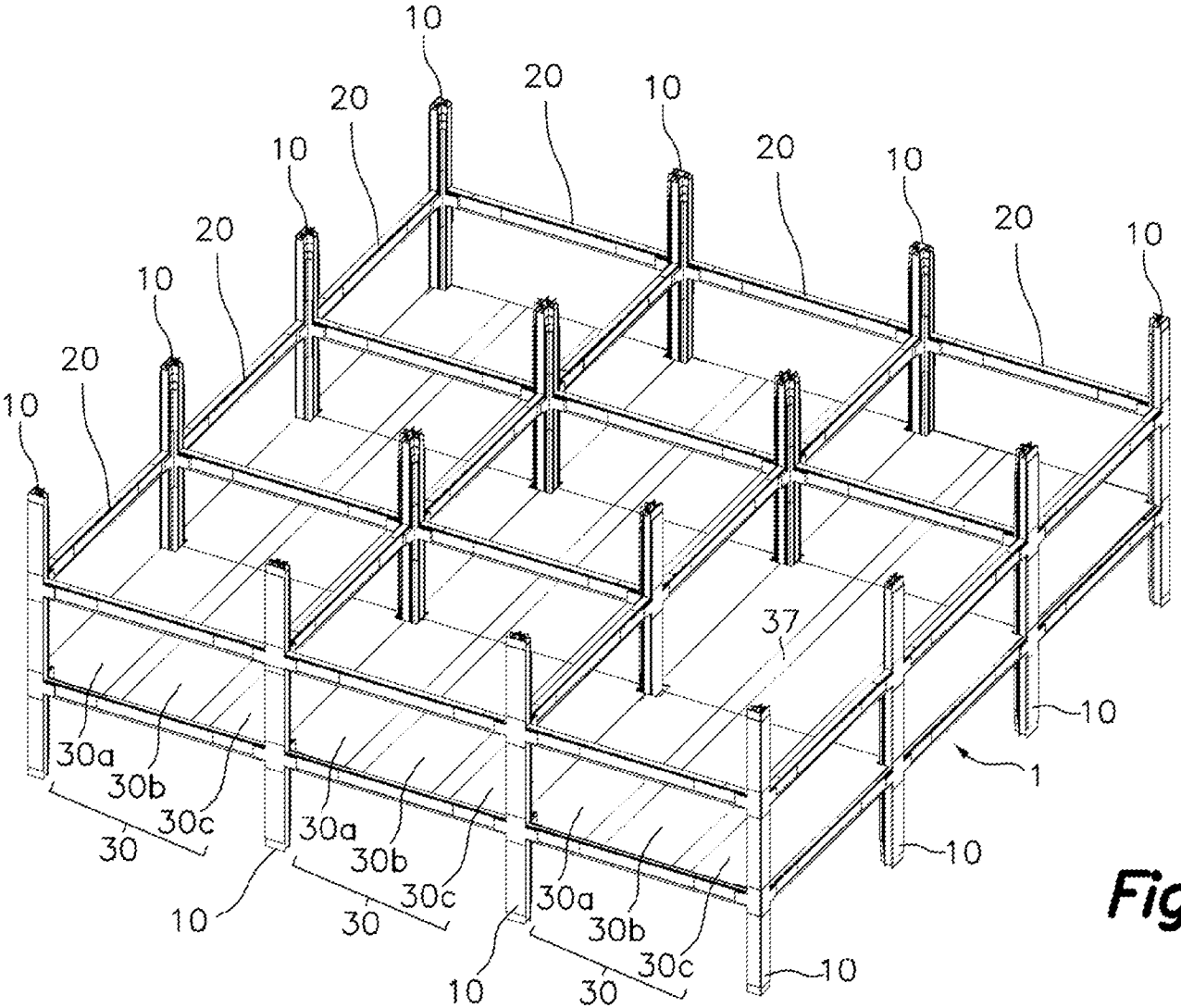
FIG. 1*a* shows a perspective view of a building under construction using the present engineered wood structural system, this figure showing a squared matrix of sixteen vertical structural elements connected supporting one first structural floor level completely covered by slab segments and supporting a matrix of beams for a second structural floor level overlapped to the first structural floor level, the vertical structural elements projecting upwards from said second structural floor level ready for supporting a matrix of beams of a third structural floor level.
Figure 1B:
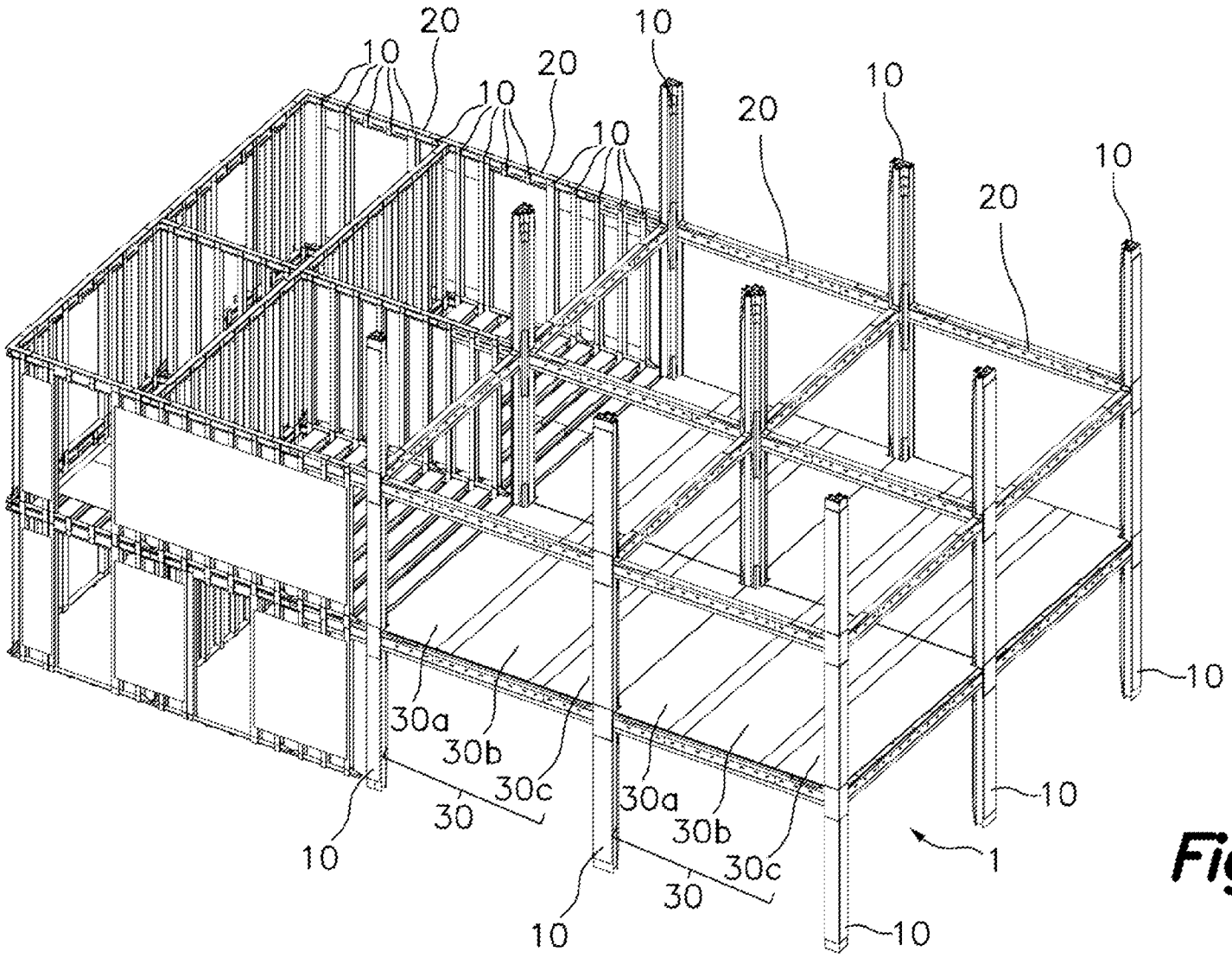
FIG. 1*b* shows a perspective view of a building under construction using the present engineered wood structural system, according to an embodiment in which half of the building has isolated vertical structural elements and the other half of the building has structural walls made of aligned vertical structural elements.

The proposed engineered wood structural system also allows for a mixed structure combining structural walls, made of aligned vertical structural elements supporting one beam, and isolated vertical structural elements, as shown in FIG. 1*b*, in which case the structural walls can actuate as a rigid core for the isolated vertical structural elements, in which case the rigidity of the structural nodes is optional.

In FIG. 1A an example of a building partially erected is shown where all the horizontal structural elements are horizontal beams 20 orthogonal to each other defining a squared matrix of beams 20 for each structural floor level.

Figure 2A:
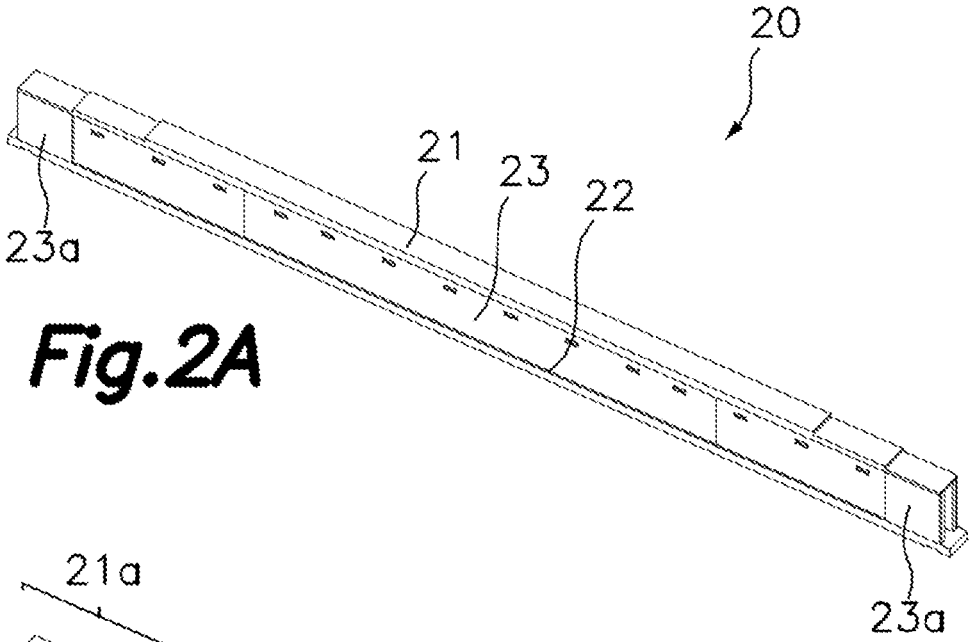
FIG. 2*a* shows a beam according to one embodiment including two parallel central vertical salts.
Figure 2B:
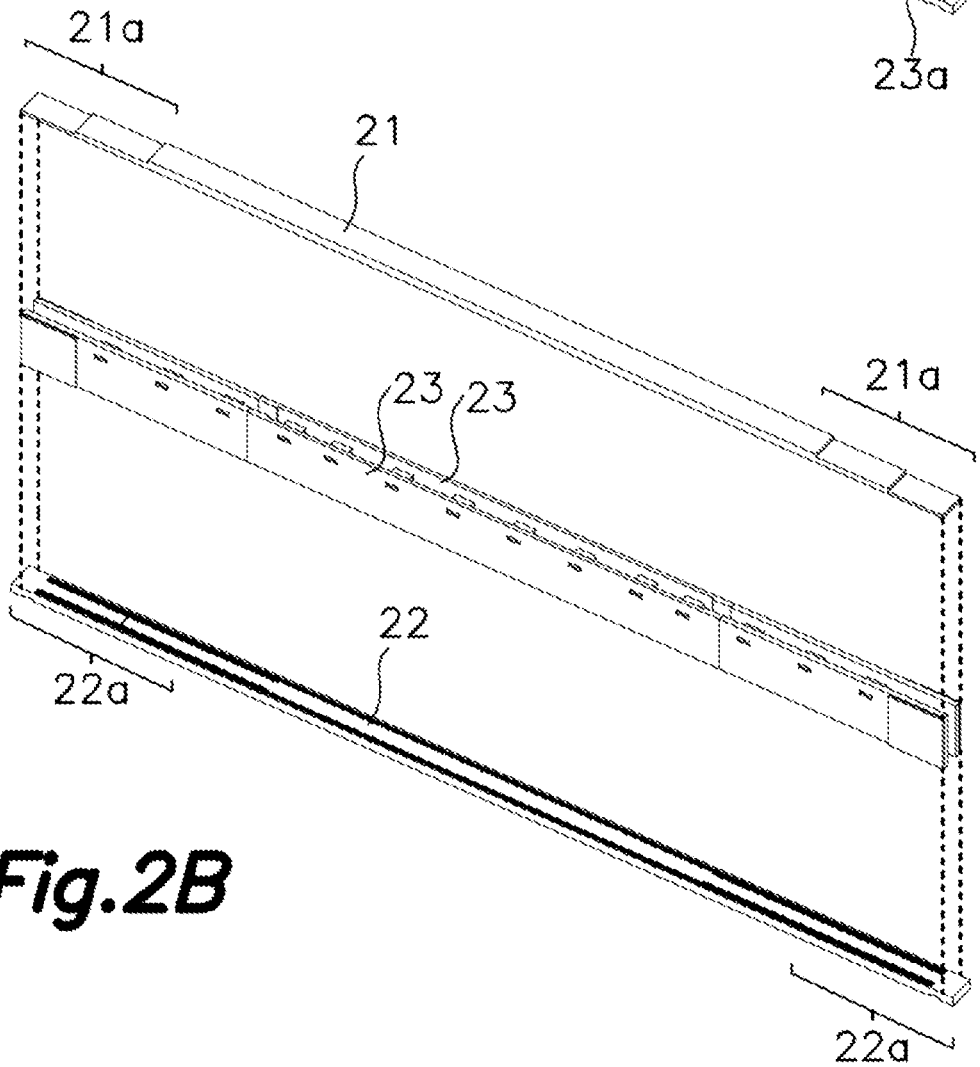
FIG. 2*b* shows an exploded view of the beam of FIG. 2*a;*

As shown on FIGS. 2*a* and 2*b*, each beam 20 comprises one upper horizontal board 21 and one lower horizontal board 22 parallel to each other separated a distance and connected to each other through second spacers 23, which in this embodiment are two parallel central vertical boards perpendicular to said upper and lower horizontal boards 21 and 22 and adhered thereto, providing an i-shaped beam 20 with double central vertical board. This shape has an optimal relation between resistance, cost and weight.

In this embodiment the upper horizontal board 21 and the lower horizontal board 22, both mainly resisting loads parallel to their main longitude, are made of laminated strand lumber.

Each of the two parallel central vertical boards have two end portions 23*a*. Each end portion 23*a*, which in this example are made of a resistant engineered wood material such plywood, is adjacent to one vertical structural element 10 where the beam 20 is supported, the rest of said two parallel central vertical boards, between the two end portions 23*a*, is made in this example of a cheaper and less resistant engineered wood material such as oriented strand board because on that central portion the loads are much less than in the end portions 23*a*.

Figure 4:
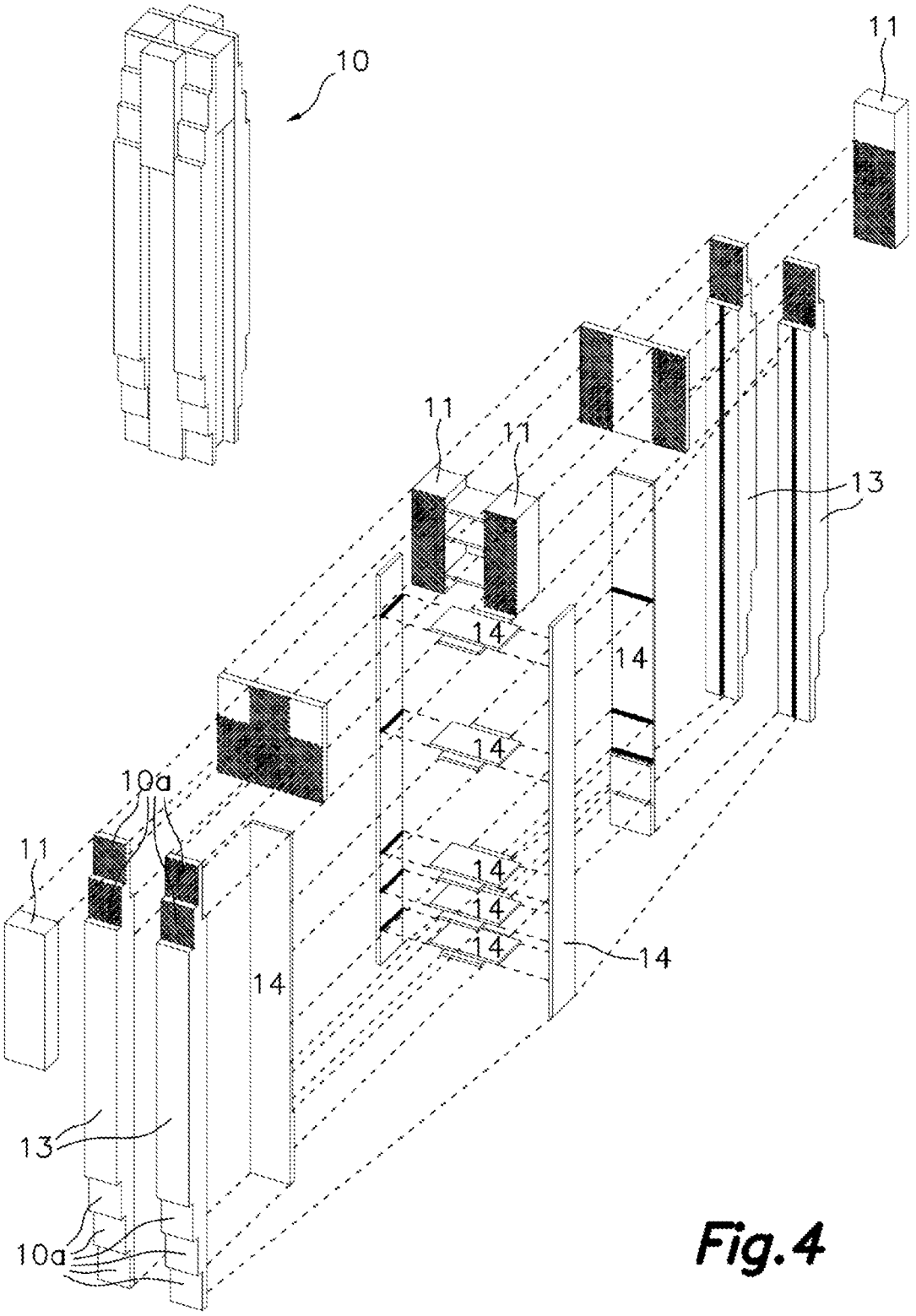
FIG. 4 is an exploded view and a perspective view of a vertical structural element segment including four vertical strut segments, vertical structural element spacer and four first seats intended for receiving and supporting four converging beams.
Figure 5A:
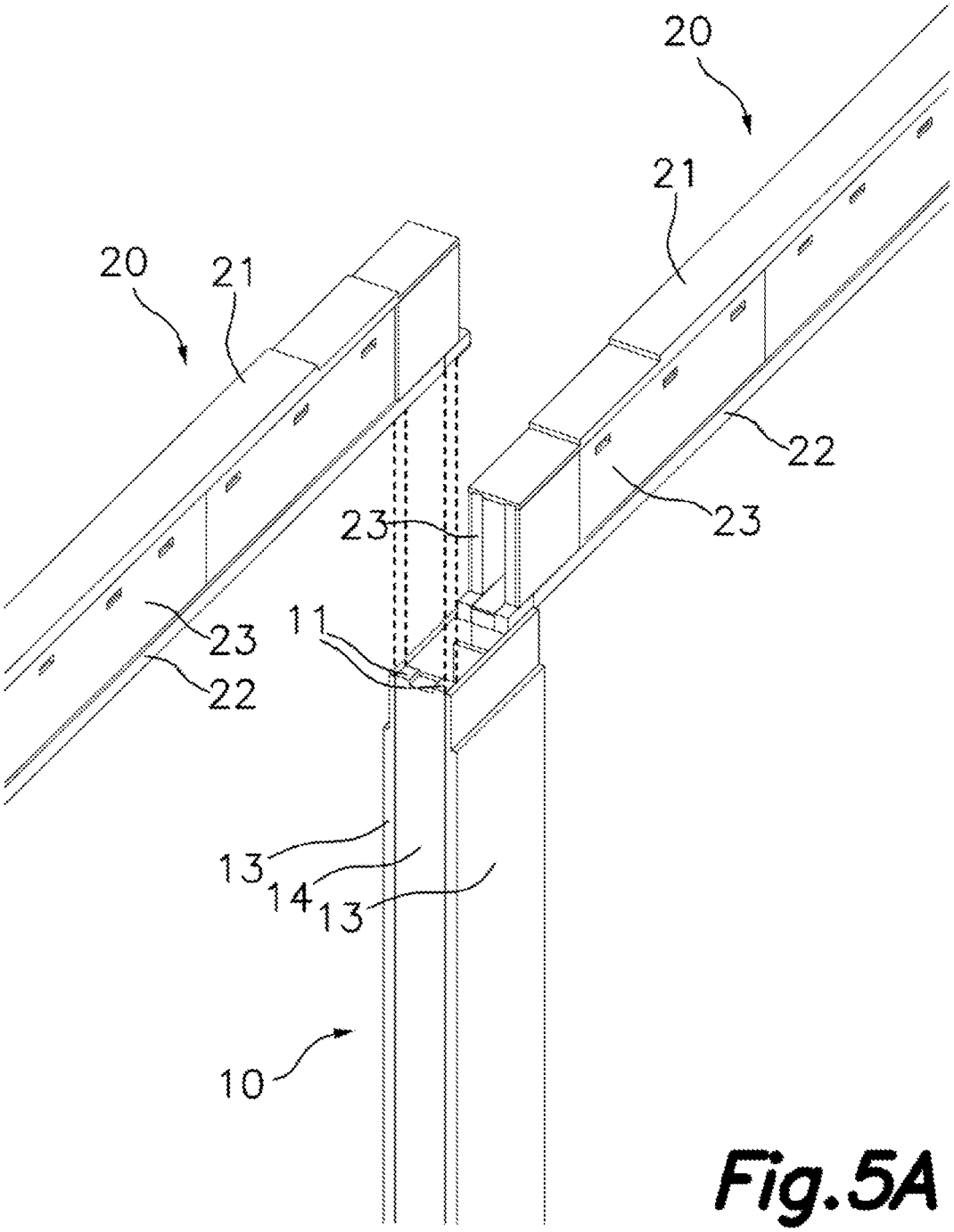
FIG. 5*a* shows a perspective view of an assembly step of a node of the structural system where two aligned beams are connected to a vertical structural element segment, the vertical structural element segment including two vertical strut segments and two first seats, one of the beams being connected to one of said first seats and one beam being separated for clarity.

As shown for example on FIGS. 4 and 5*a*, each vertical structural element 10 include a first seat 11 for each horizontal structural element supported on said vertical structural element 10, and the horizontal structural element includes a second seat configured to be supported on top of said first seat 11.

Figure 11:
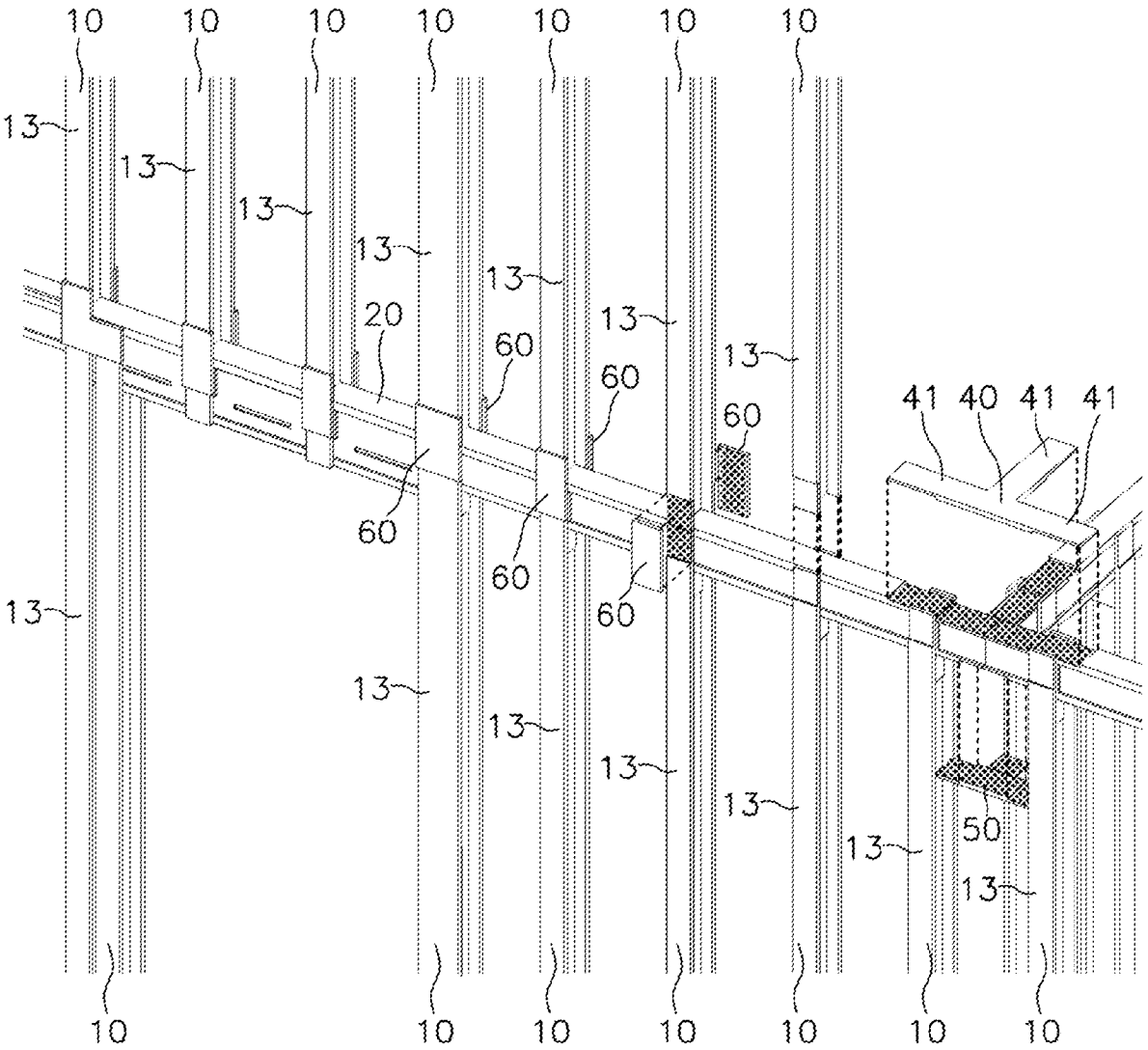
FIG. 11 shows a perspective view of a structural wall comprising a beam supported on multiple aligned vertical structural elements each including two vertical struts and two vertical connectors, the beam including a reinforced portion with an additional lower horizontal board for a door opening, and one end of the beam being connected with other two beams by an upper connector and a lower connector.

When reduced loads are transferred from the horizontal structural element to the vertical structural element 10, for example when a beam 20 is supported on multiple aligned vertical structural elements 10, as shown for example on FIG. 11, the beam 20 can be supported on the first seat 11 of each vertical structural element 10 through second seats defined in the lower horizontal board 22, compressing said lower horizontal board 22 in a vertical direction which is sub-optimal but resistant enough for such reduced loads.

When the loads transferred from the beam 20 to the vertical structural elements 10 are significant, for example when a long beam comprised between 3 m and 8 m is supported on the vertical structural elements 10 only on its ends, the end portion 23*a* of said two central vertical boards of each beam 20 will be vertically supported on said first seat 11, transferring vertical loads from the beam 20 to the vertical structural element 10 in a direction parallel to the main surface of the central vertical boards which is optimal for load transfer.

Because this load transfer generates compression loads and shear loads on said end portion 23*a* of the central vertical boards, said end portions 23*a* are preferably made of engineered wood including veneer fibers in different directions, such as plywood.

In the example shown in the figures, each first seat 11 may comprise two vertical and parallel boards perpendiculars to the central vertical boards to be supported, each board including one central notch between two horizontal support areas. Each of the support areas is intended to be in contact with one of the two central vertical boards of the beam 20 to be supported and the central notch is intended to house the end portion 22*a* of the lower horizontal board 22 of the beam 20 supported on said first seat 11, preventing the contact between said end portion 22*a* and the first seat 11. Alternatively, the first seats 11 are an engineered wood block attached to the vertical struts.

According to the embodiment shown in the figures, each vertical structural element 10 include multiple vertical struts 12 continuous along the entire longitude of the building, said vertical struts 12 being separated in the horizontal direction by vertical structural element spacers 14 placed between and adhered to said struts 12, generating a hollow vertical structural element 10. The separation between the struts 12 of the vertical structural element 10 allow the insertion of the end portion of all the beams converging on said vertical structural element 10, including the end portions 23*a* of the correspondent central vertical boards, in said space between the struts 12 of the vertical structural element 10, allowing the vertical continuity of the struts 12, which surround the end portion of the beams 20.

The first seats 11 are also included between and adhered to the struts 12, said first seats 11 being interposed between, and connected to, the struts 12 within the hollow vertical structural element, permitting the transfer of loads from the beams 20 to the vertical structural element 10 in an area close to the geometric center of the vertical structural element 10, reducing the bending loads generated on the vertical structural element 10.

The loads transferred from the beams 20 to the vertical structural elements 10 through said first seats 11 are concentrated on said struts 12, accumulated from the multiple structural floor levels and conducted to the foundation where said vertical structural elements 10 are supported.

The multiple beams 20 of the same structural floor level converging on the same vertical structural element 10 are connected to each other at least through an upper connector 40 and through a lower connector 50, as shown in FIGS. 5*b* to 8*b*.

The upper connector 40 is a flat horizontal sheet including as many horizontal connector arms 41 as beams 20 of the same structural floor level converge on said vertical structural element 10, being the angular distribution of said horizontal connector arms 41 coincident with the angular distribution of the beams 20 converging on said vertical structural element 10.

Each horizontal connector arm 41 is adhered to the end portion 21*a* of one upper horizontal board 21 of one beam 20 supported on said vertical structural element 10. Said upper connector 40 transmits loads between the upper horizontal boards 21 of all the beams 20 converging on said vertical structural element 10.

According to a preferred embodiment shown in the figures, the end portion 21*a* of each upper horizontal board 21 and the horizontal connector arm 41 adhered thereto include complementary recessed staggered steps coupled and adhered to each other, each step being a flat surface parallel to the upside main surface of the upper horizontal board 21. Said connection through recessed staggered steps produces a distributed transfer of the loads and also allows the upper connector 41 to be flush with said upside main surface of the upper horizontal board 21 of the beam 20. Said upper connector 40 is preferably made of engineered wood including veneer fibers in different directions, such as plywood.

The lower connector 50 comprises a tapered shape block, for example an inverted frusto-pyramidal shape, tightly inserted in a descendent direction between the end portion 22*a* of the lower horizontal boards 22 of the beams 20 of the same structural floor level converging on the same vertical structural element 20. Said lower connector 50 transmits loads between the lower horizontal boards 22 of the converging beams 20 of the same structural floor level.

Each lower horizontal board 22 may include a reinforcement adhered to its end portion 22*a*, between the two central vertical boards of the beam 20, producing an increase in the thickness and in the resistance of said end portion 22*a* of the lower horizontal board 22 which contacts with the lower connector 50.

Figure 5B:
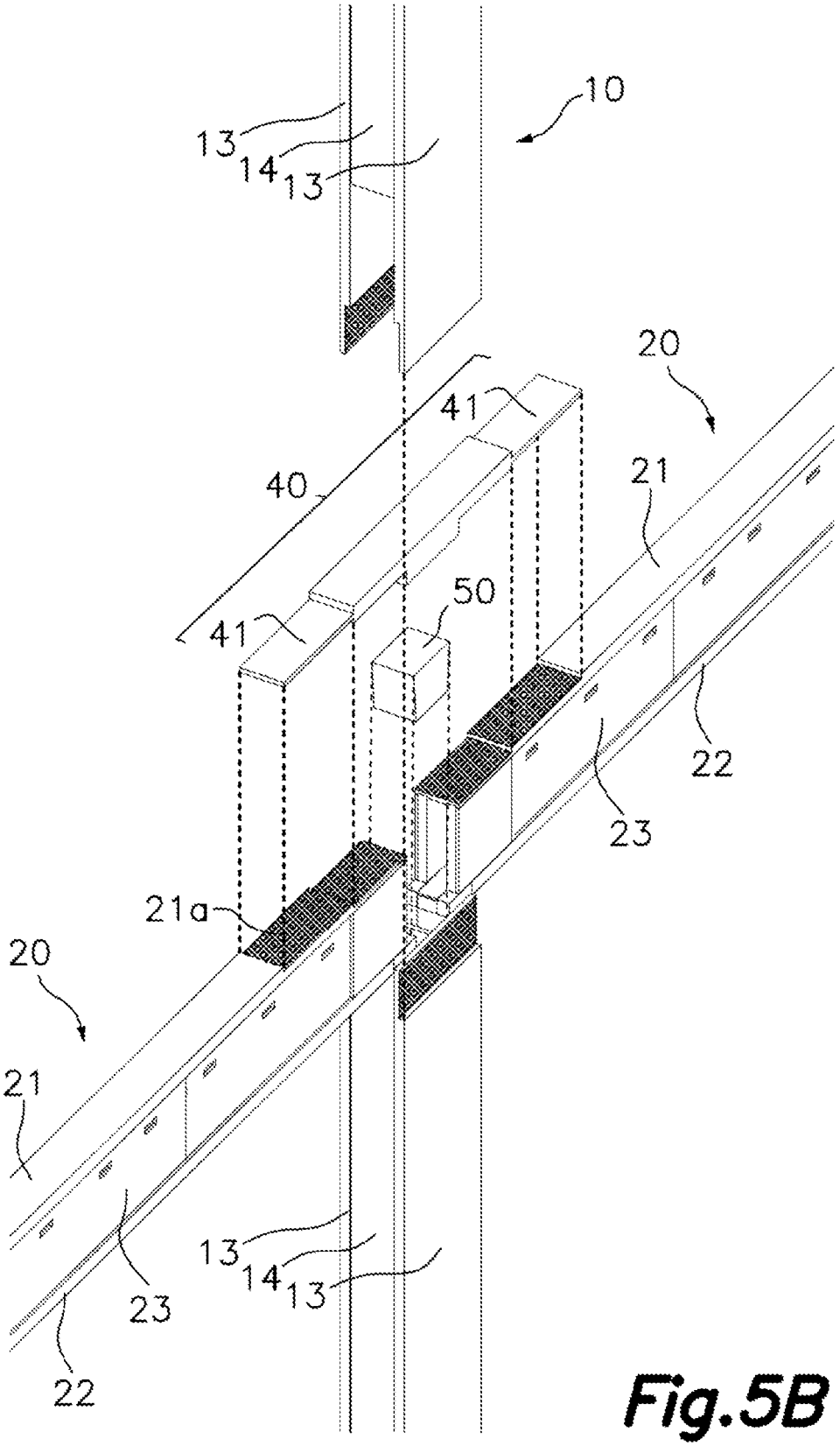
FIG. 5*b* shows a further assembly step of the same node shown on FIG. 5*a*, where both converging beams are supported on the first seats and where the upper connector, the lower connector and the subsequent vertical structural element segment are shown in an exploded view.
Figure 6A:
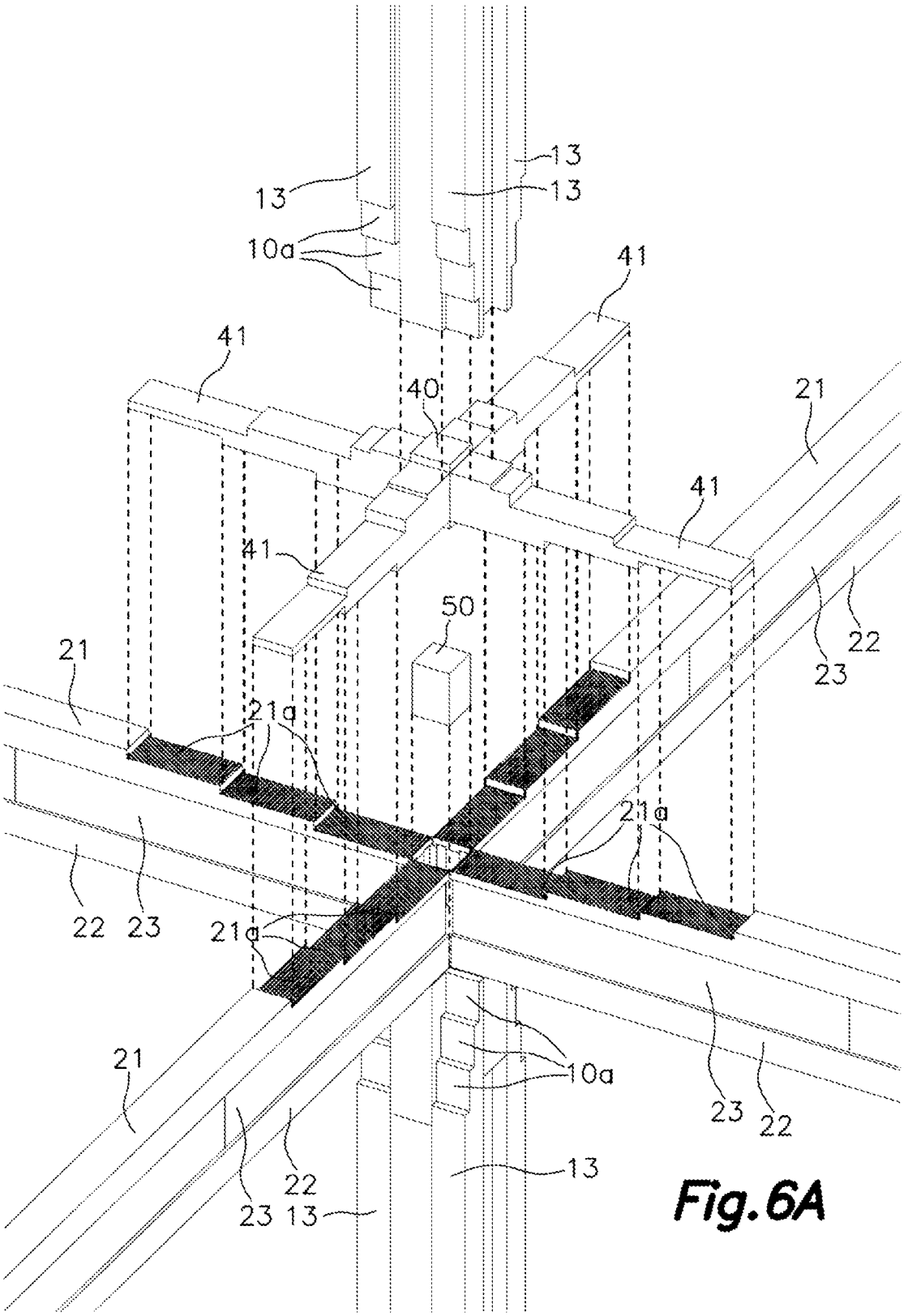
FIG. 6A shows a view equivalent to FIG. 5*b* but for a node where four converging beams are supported on four first seats of the same vertical structural element segment but for a node where successive aligned vertical strut segments are connected to each other through four vertical connectors surrounding the node.
Figure 6B:
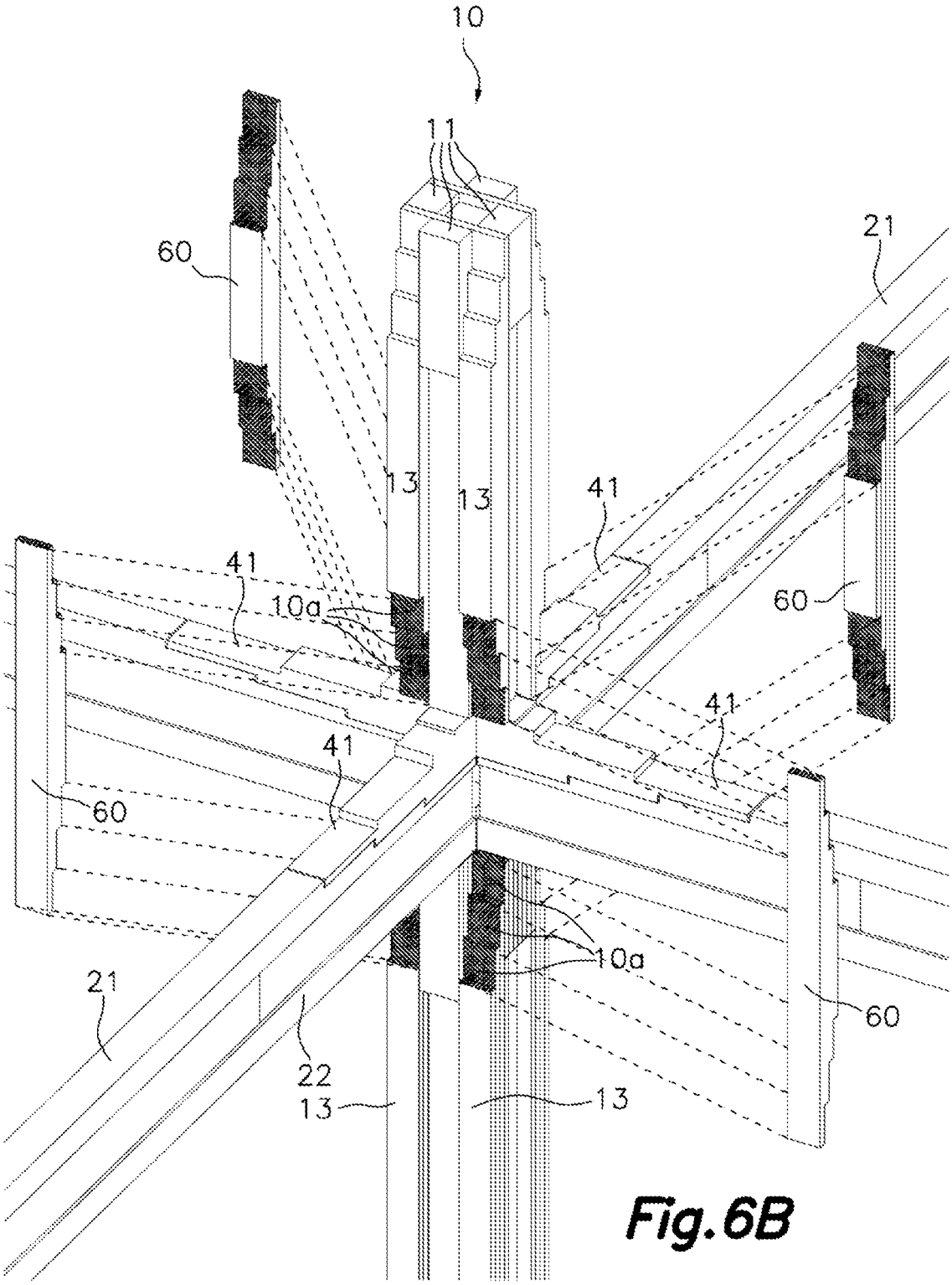
FIG. 6B shows the node shown on FIG. 6A completely assembled where the two consecutive vertical structural element segments have respective vertical strut segments adhered to each other though said vertical connectors producing a continuous vertical structural element.
Figure 6C:
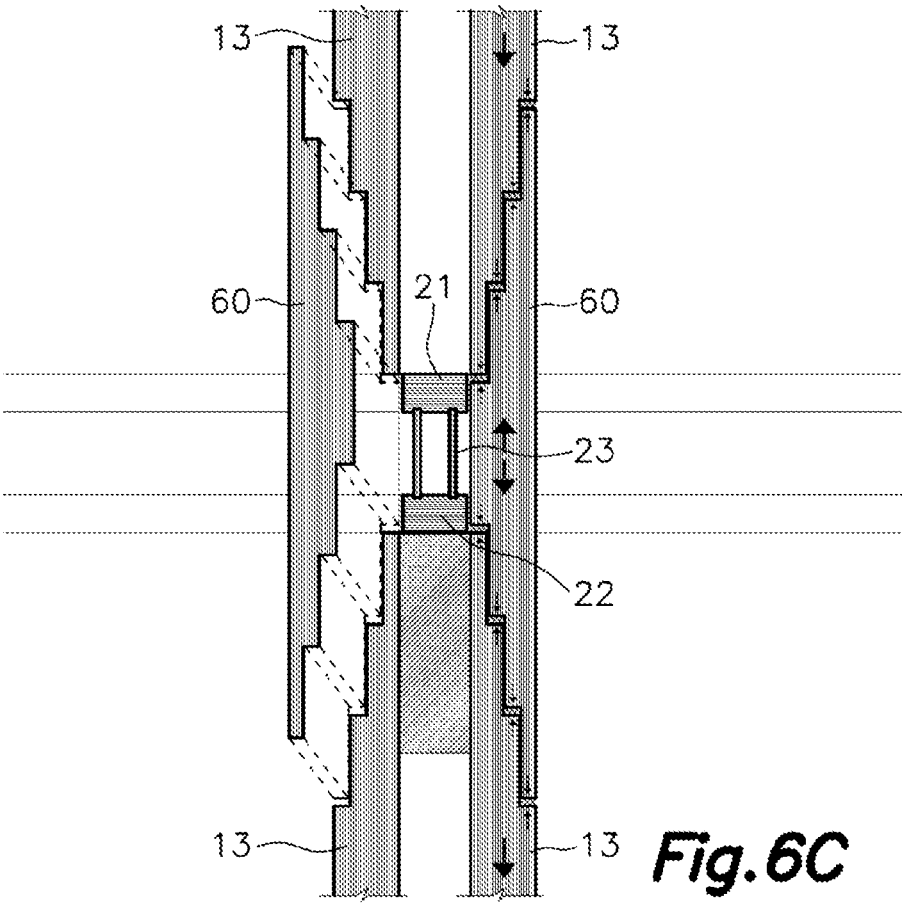
FIG. 6C shows a vertical cross section through two vertical connectors of the structural node shown in FIG. 6B, wherein vertical loads transmission through one of said vertical connectors are shown as vertical arrows and wherein tolerance gaps between the vertical connector and the vertical structural element segments are shown filled with hardened adhesive.
Figure 6D:
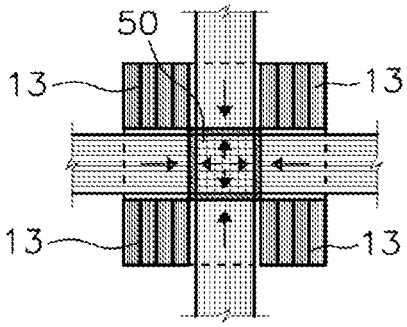
FIG. 6D shows a horizontal cross section through the lower connector of the structural node shown in FIG. 6B wherein compression of the lower connector by the four converging lower horizontal boards are shown as arrows and wherein tolerance gaps between the lower connector and the horizontal structural elements are shown filled with hardened adhesive.
Figure 6E:
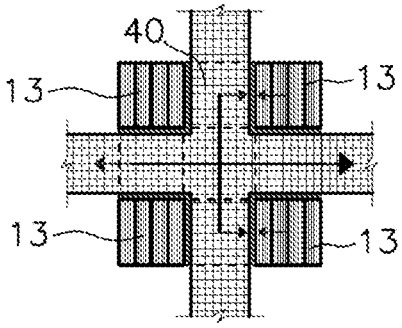
FIG. 6E shows a horizontal cross section through the upper connector of the structural node shown in FIG. 6B wherein the traction loads on the right side are bigger than the traction loads in the left side, producing a net right traction load which is transferred by the vertical connector to two vertical struts of the left side of the vertical structural element and wherein tolerance gaps between the upper connector and the vertical struts are shown filled with hardened adhesive.
Figure 6F:
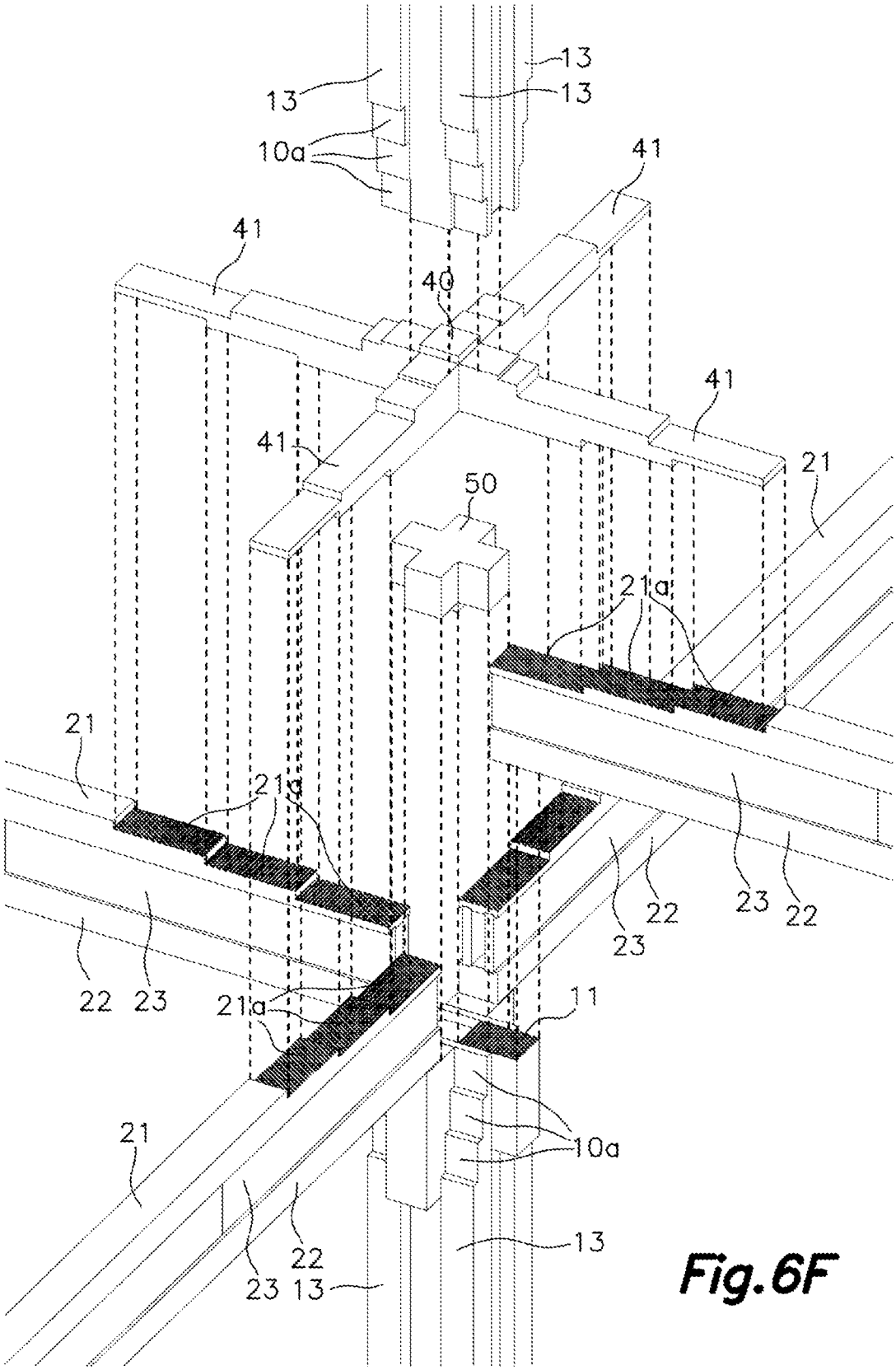
FIG. 6F shows an alternative embodiment of FIG. 6A wherein the first seats protrude outwardly from the vertical structural element and the space between the converging horizontal structural elements is slightly bigger, including a bigger lower connector.
Figure 6G:
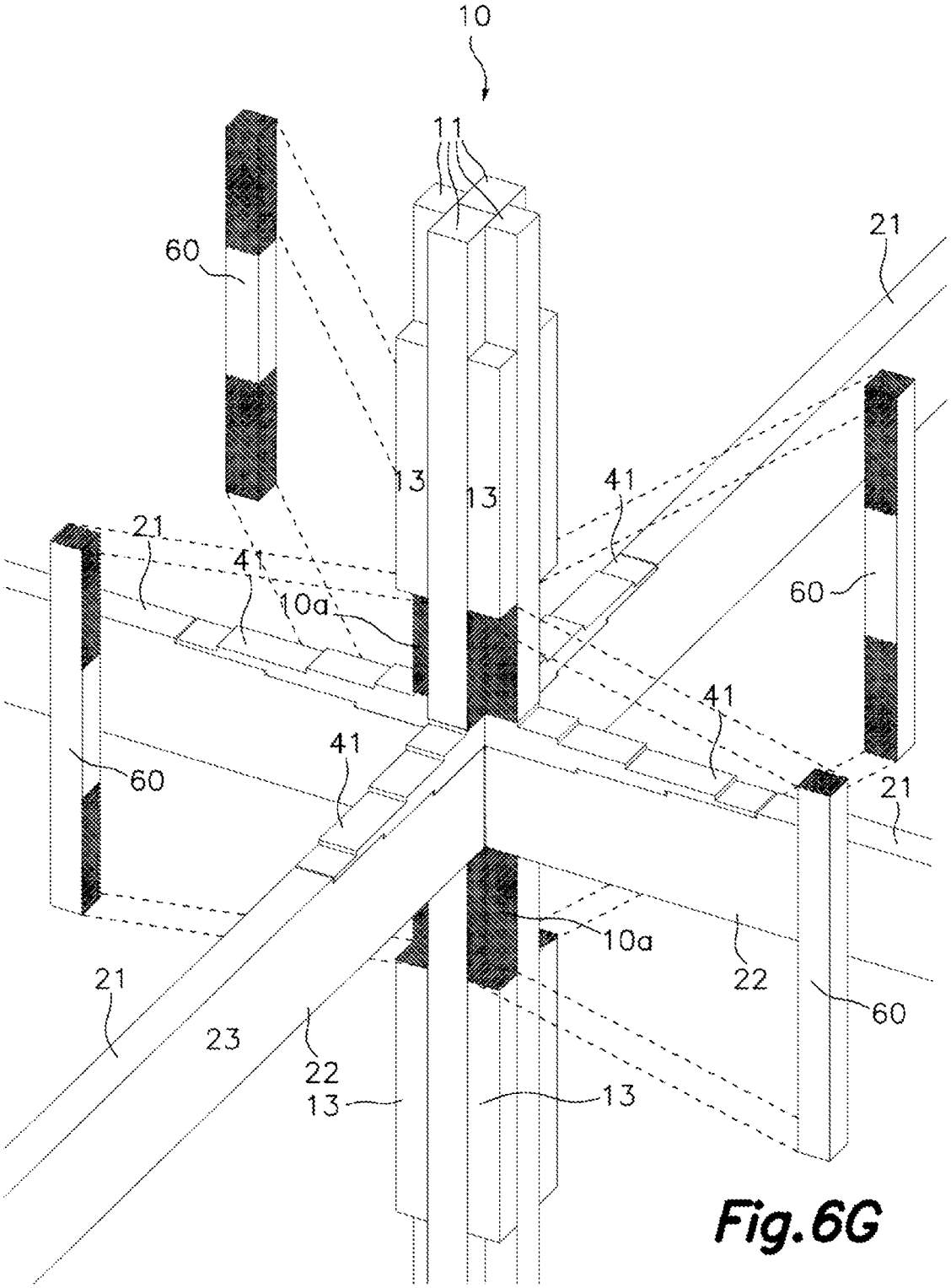
FIG. 6G shows the node shown on FIG. 6A but according to an alternative embodiment according to which the vertical connectors does not include staggered step configurations and according to which the second spacers of the horizontal structural elements are overlapped horizontal boards piled between the upper and lower boards.
Figure 6H:
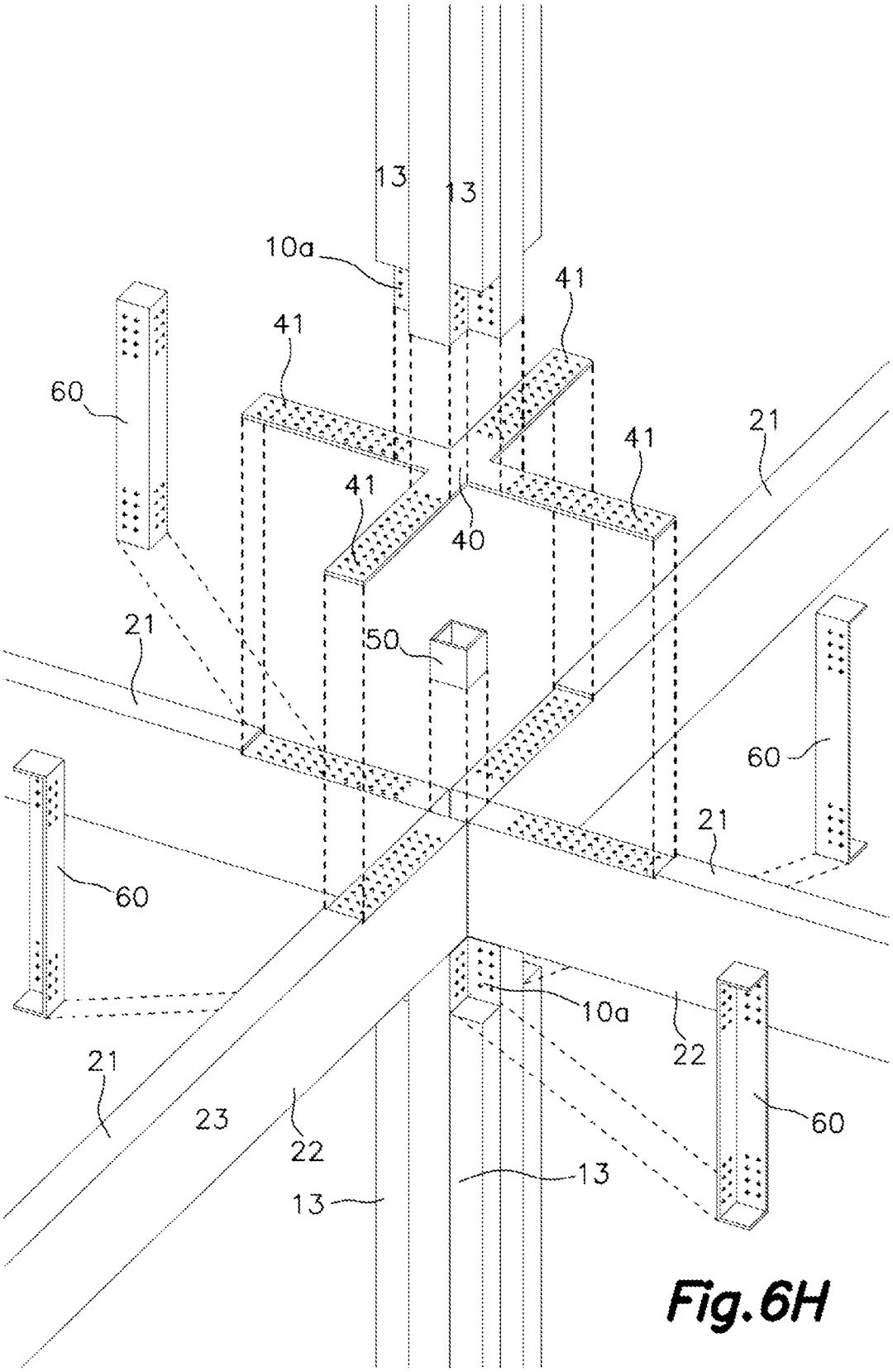
FIG. 6H shows the node shown on FIG. 6A but according to an alternative embodiment according to which the vertical connectors, and the upper and lower connectors, are made of metal or carbon fiber and does not include staggered step configurations and according to which the second spacers of the horizontal structural elements are overlapped horizontal boards piled between the upper and lower boards.
Figure 8A:
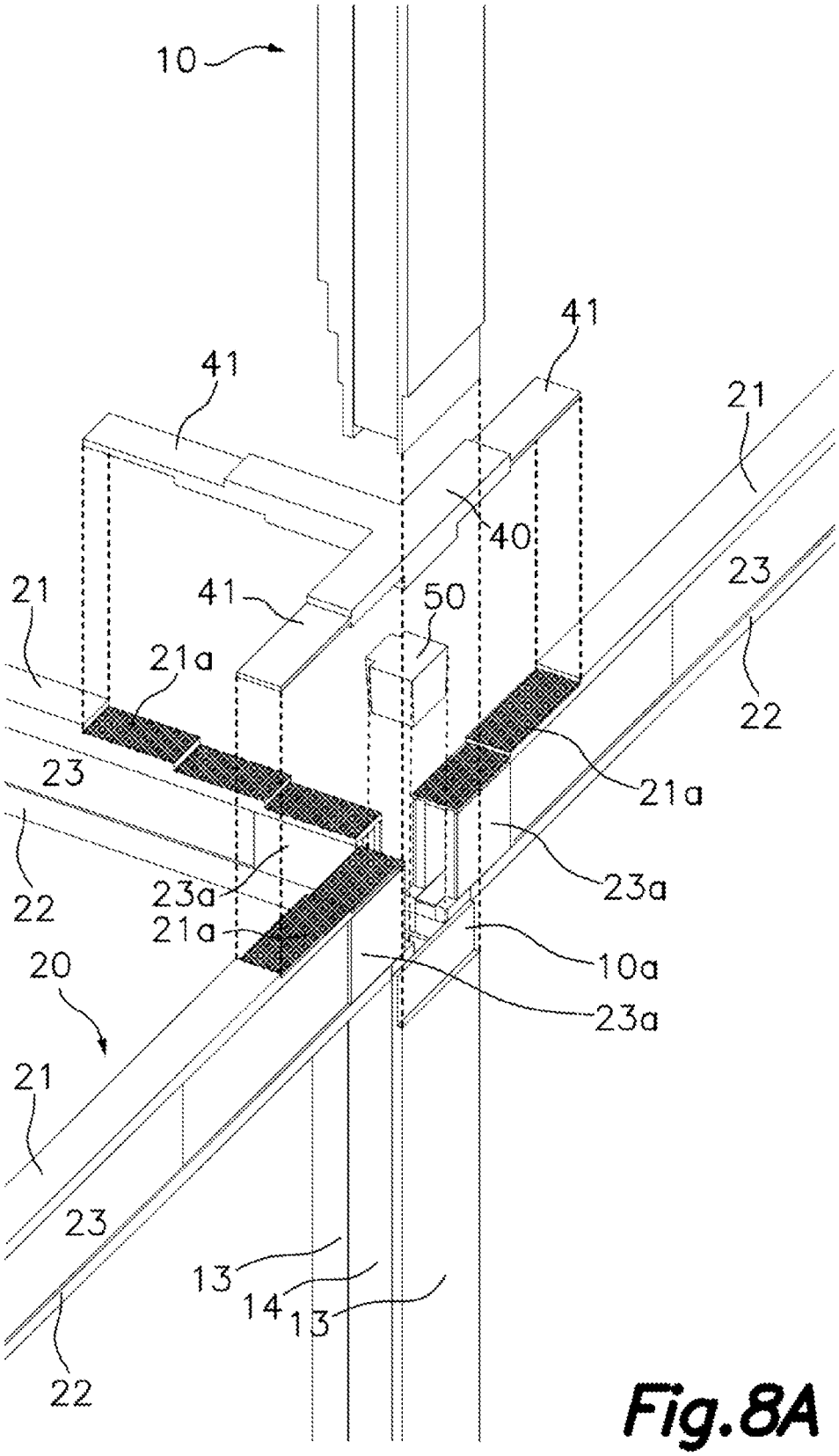
FIG. 8*a* shows an embodiment equivalent to that shown on FIG. 5*b* but for a node where three beams converge on the same vertical structural element segment which include three first seats, two aligned beams and one beam perpendicular to the other two beams, and where the upper connector include three horizontal connector arms.
Figure 8B:
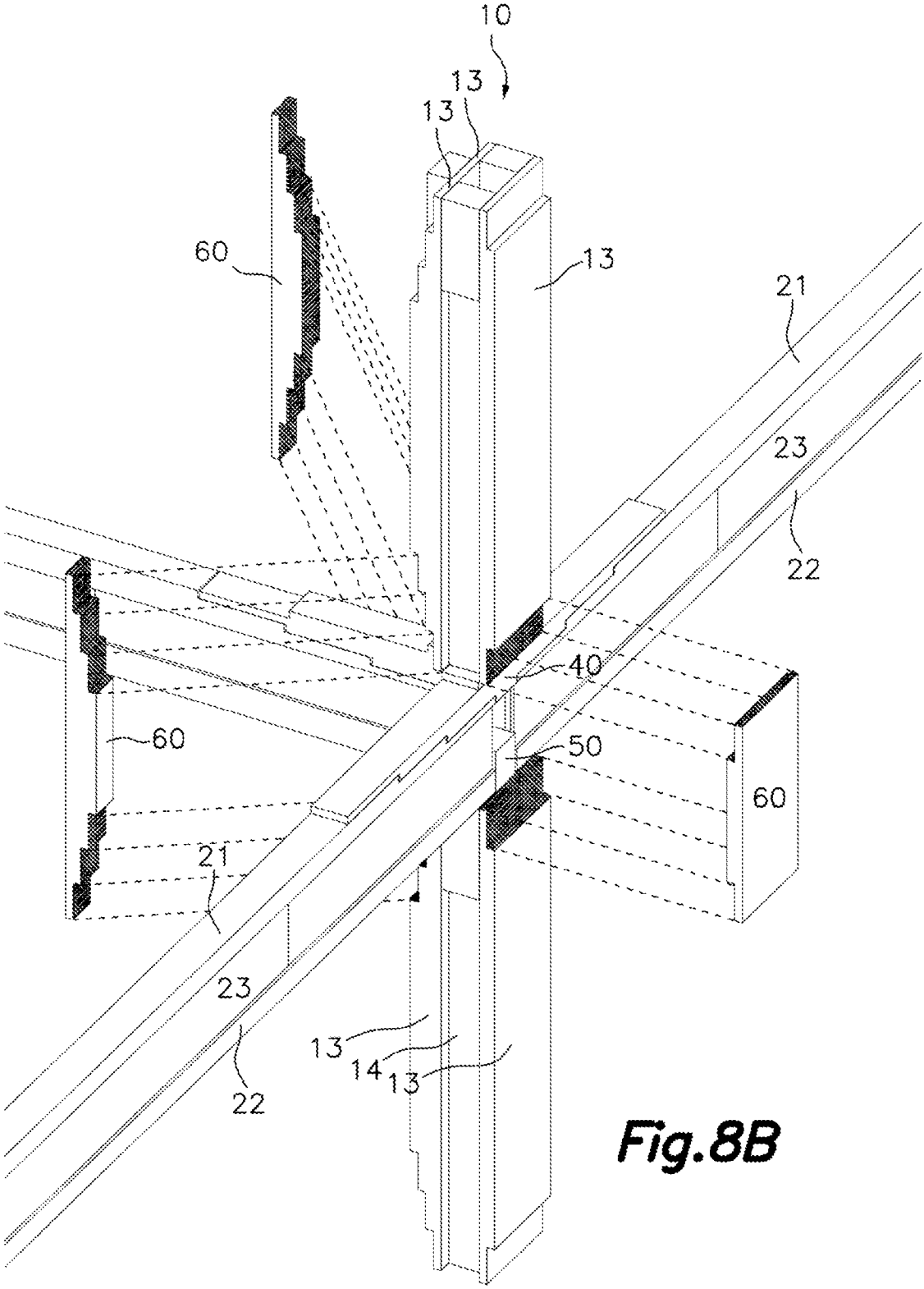
FIG. 8*b* shows the node shown on FIG. 8*a* further including vertical connectors, which are shown in exploded position, to be adhered to the vertical pillar surfaces of two successive vertical strut segments of the vertical structural element.
Figure 9A:
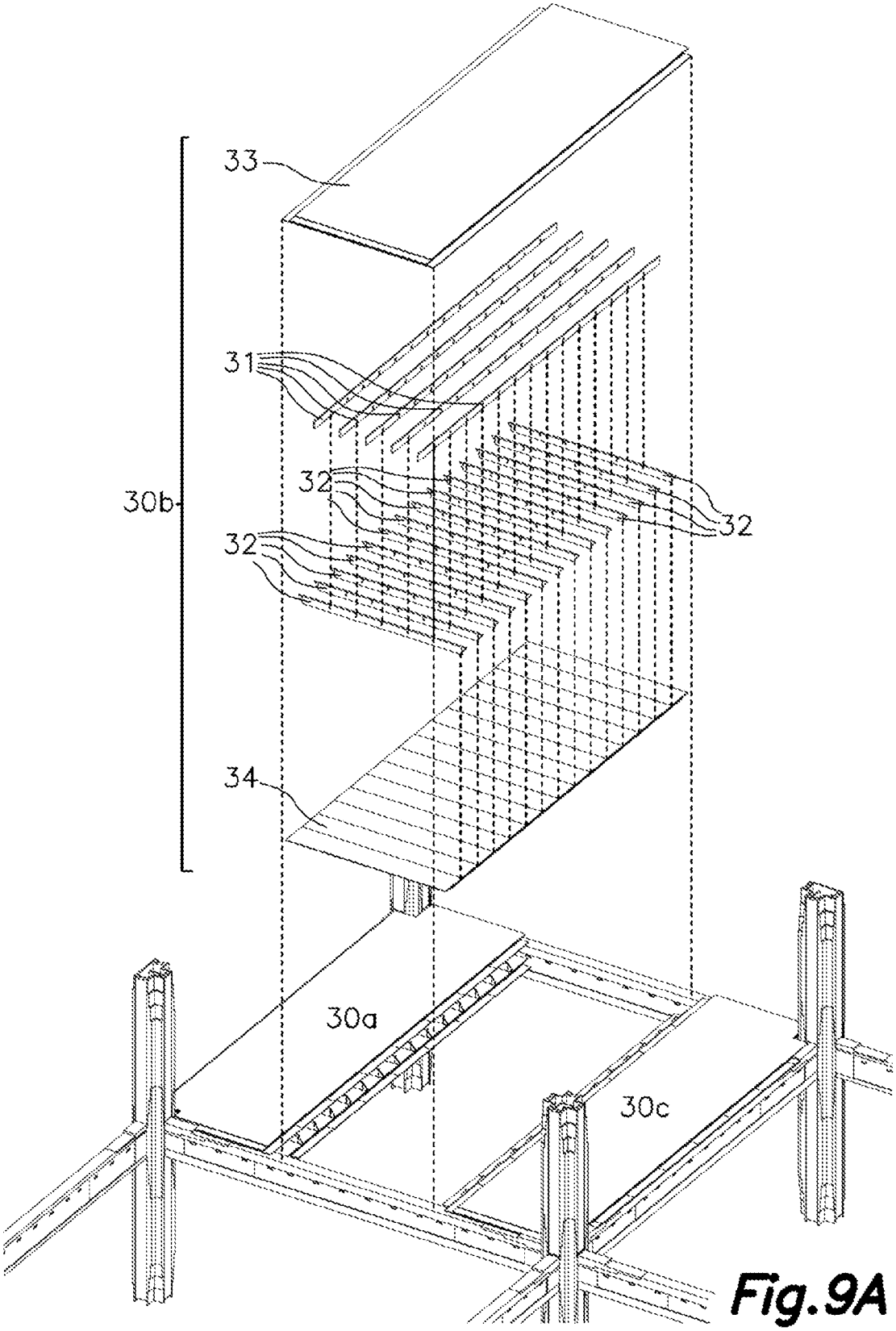
FIG. 9*a* shows a perspective view of a matrix of beams with one slab segment, made of three slab segments, installed therein, the central slab segment being shown in an exploded view.
Figure 9B:
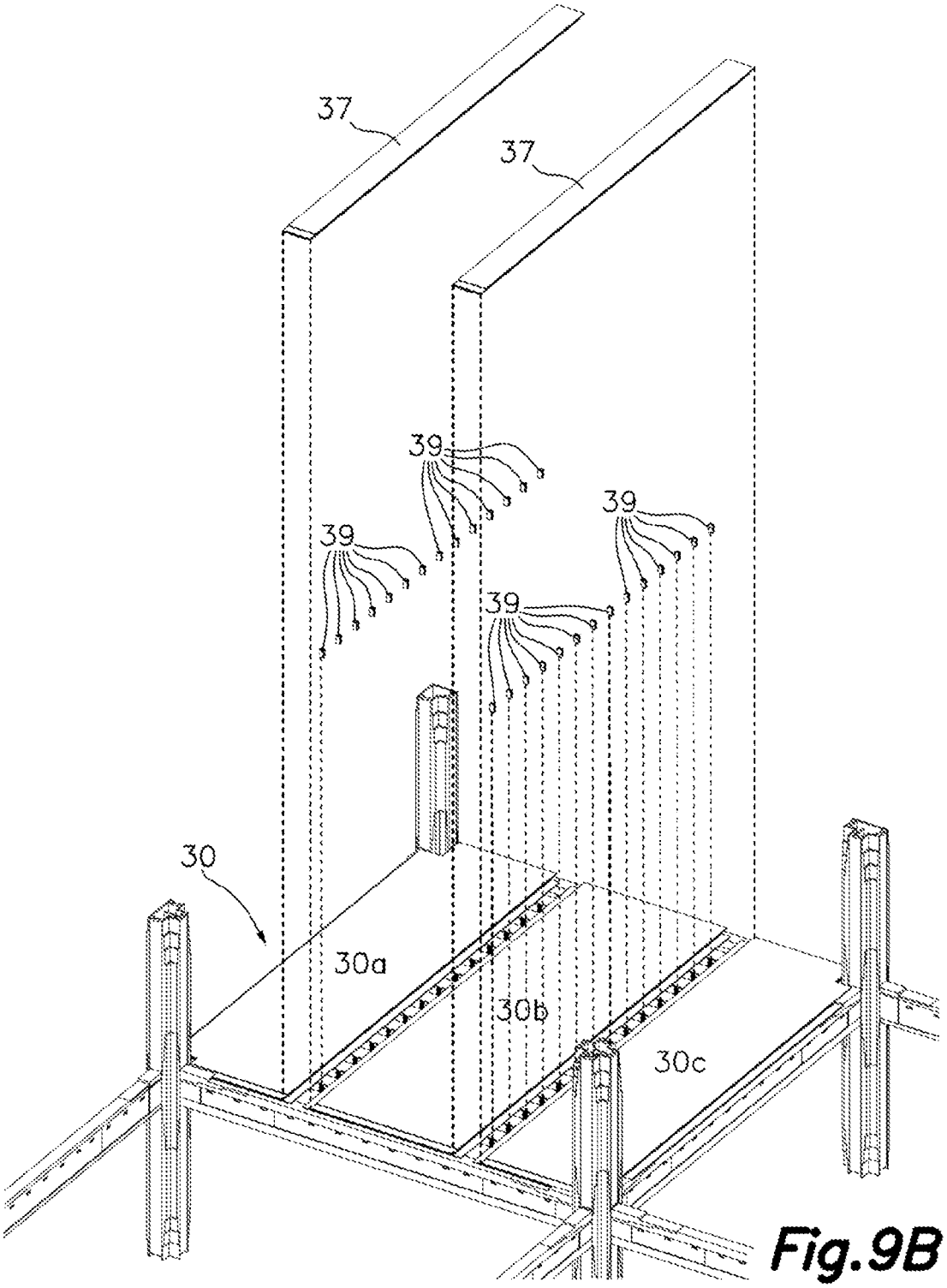
FIG. 9*b* shows the same than FIG. 9*a* but with the three slab segments being installed on the matrix of beams, showing the second rib joints and the upper sheet joints in an exploded view.
Figure 9C:
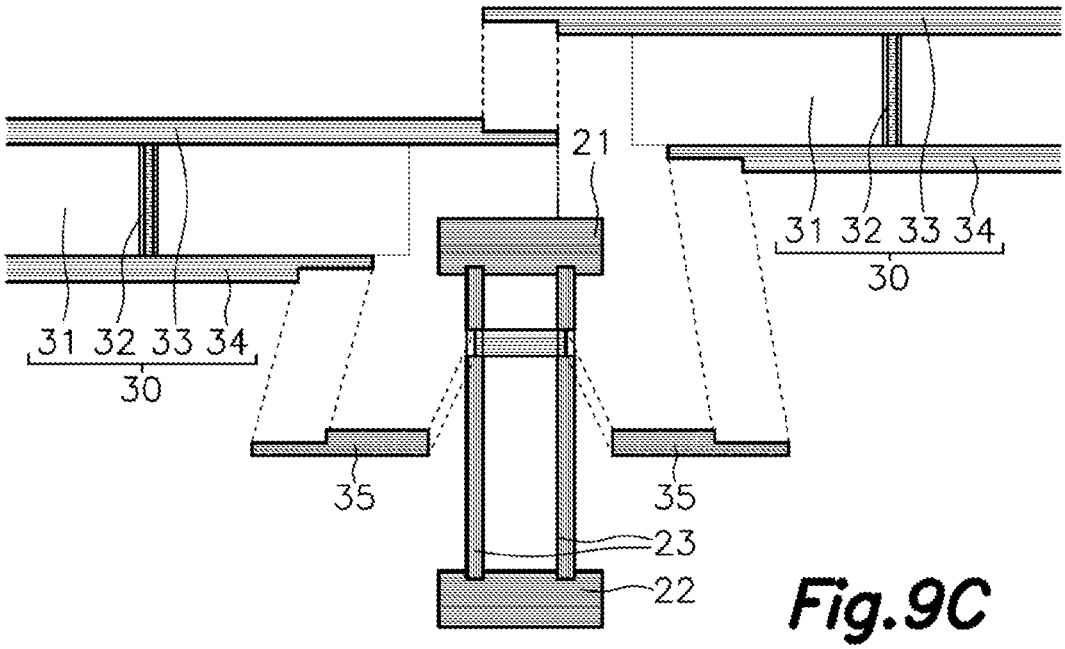
FIG. 9C is an exploded section view of one beam and two adjacent slab segments supported on said beams.
Figure 9D:
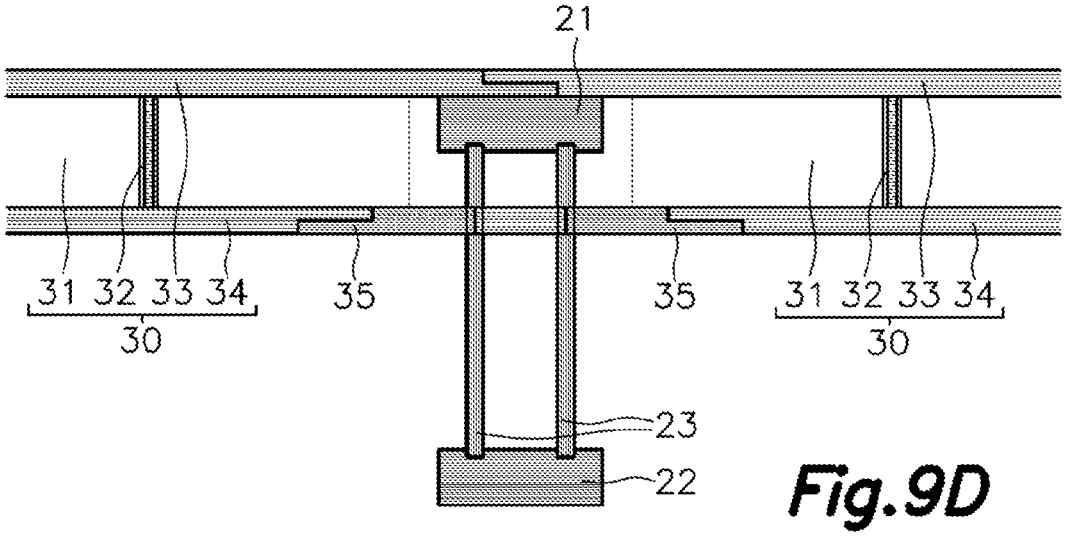
FIG. 9D is the same view than the FIG. 9C but in an assembled position, where the upper horizontal board and the lower horizontal sheet of both adjacent slab segments are connected to each other.
Figure 9E:
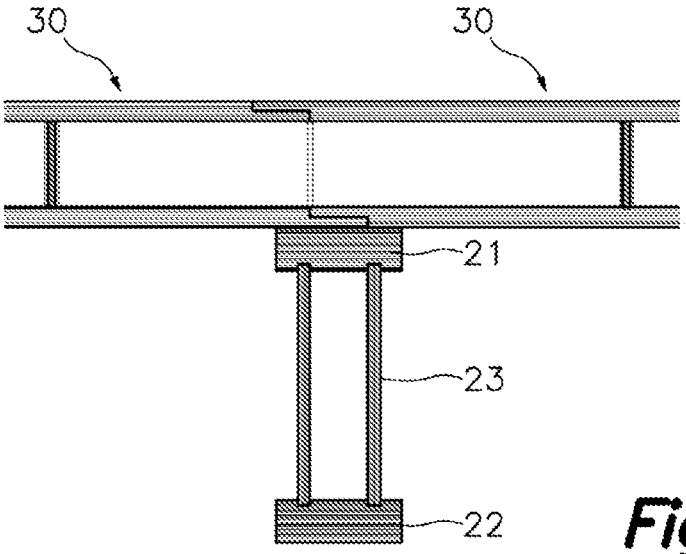
FIGS. 9E, 9F and 9G show a cross section of three alternative embodiments of two adjacent slab segments supported on a beam, different from the embodiment shown in FIG. 9D.
Figure 9F:
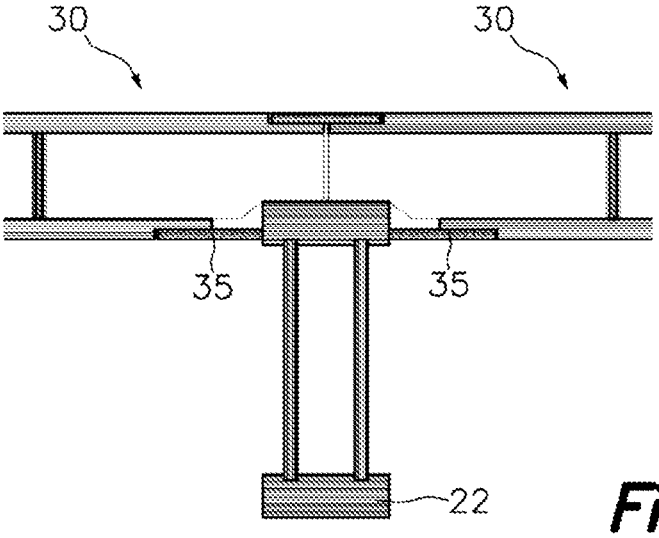
Figure 9G:
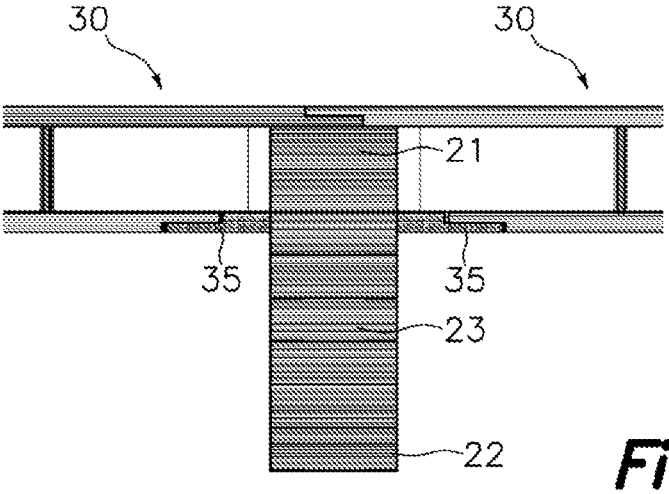
Figure 10:
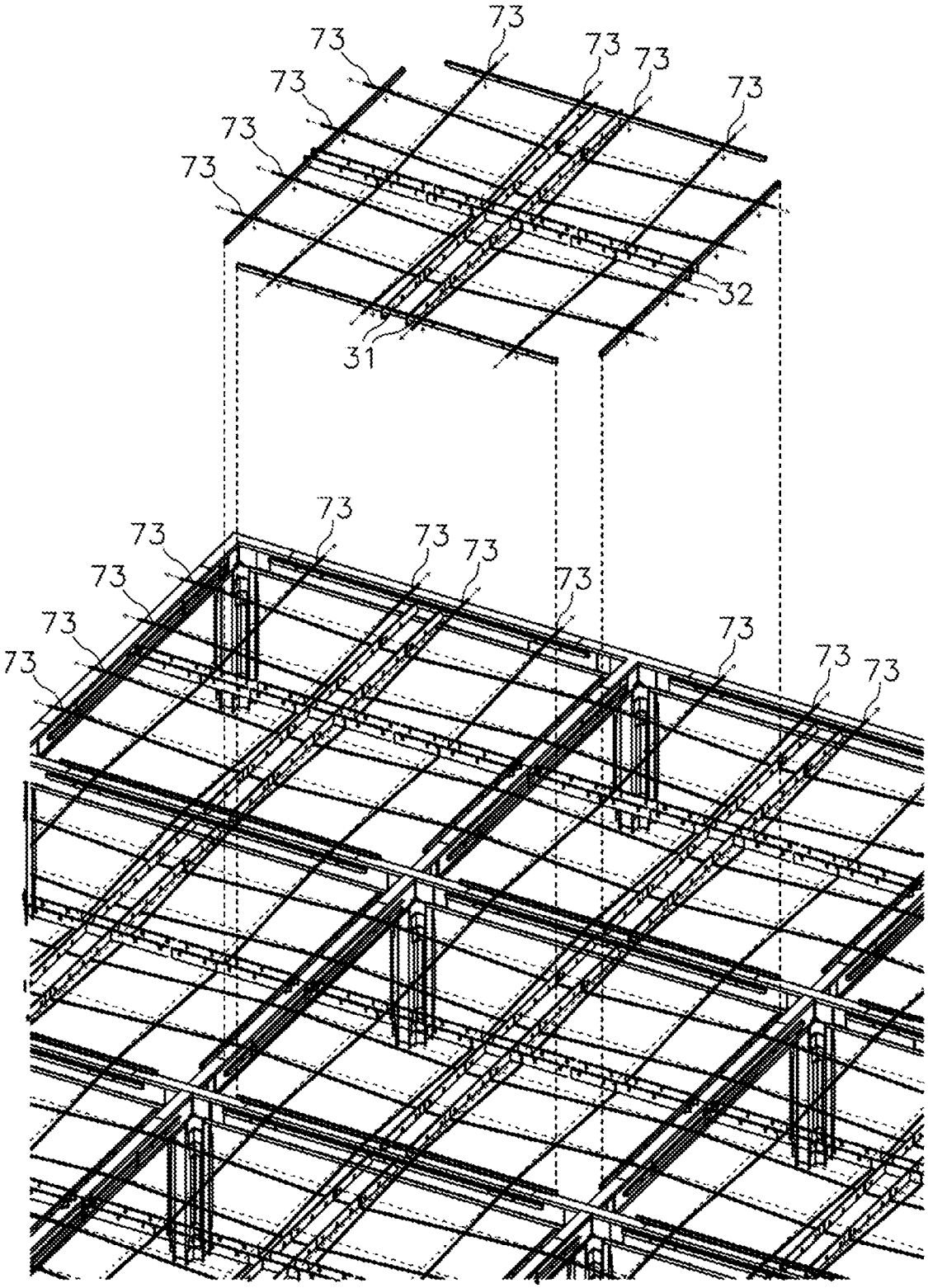
FIG. 10 shows a perspective view of a matrix of beams of one structural floor level including a schematic view of the disposition of the slab post-tensioning cables within the structural floor level, showing, of each slab segment, only two first and second ribs for clarity reasons.

As shown in FIGS. 5*b*, 6*a* and 8*a*, said lower connector 50 is a tapered shape block inserted in the center of the hollow vertical structural element 10 defined between the vertical struts 12 constitutive of said vertical structural element 10, between the end portion of the converging beams 20, said lower connector 50 being compressed between the end portion 22*a* of the lower horizontal boards 22 of the converging beams 20 of the same structural floor level.

Optionally, each beam 20 can be also connected to the vertical structural element 10 through at least one vertical connector 60 made of a vertical sheet of engineered wood, as shown on FIGS. 7*a* to 8*b*.

Each vertical connector 60 is adhered to one vertical pillar surface 10*a* of one vertical strut 12 of the vertical structural element 10, below and above the structural node.

Said vertical connector 60 transmits shear, bending and twisting loads from the beams 20 to the struts 12 of the vertical structural element 10, and is preferably made of engineered wood including veneer fibers in different directions, such as plywood.

Each strut 12 of one single continuous vertical structural element 10 is typically made of multiple successive vertical strut segments 13 rigidly connected to each other, each vertical strut segment 13 having the same high as the distance between successive structural floor levels.

Figure 5C:
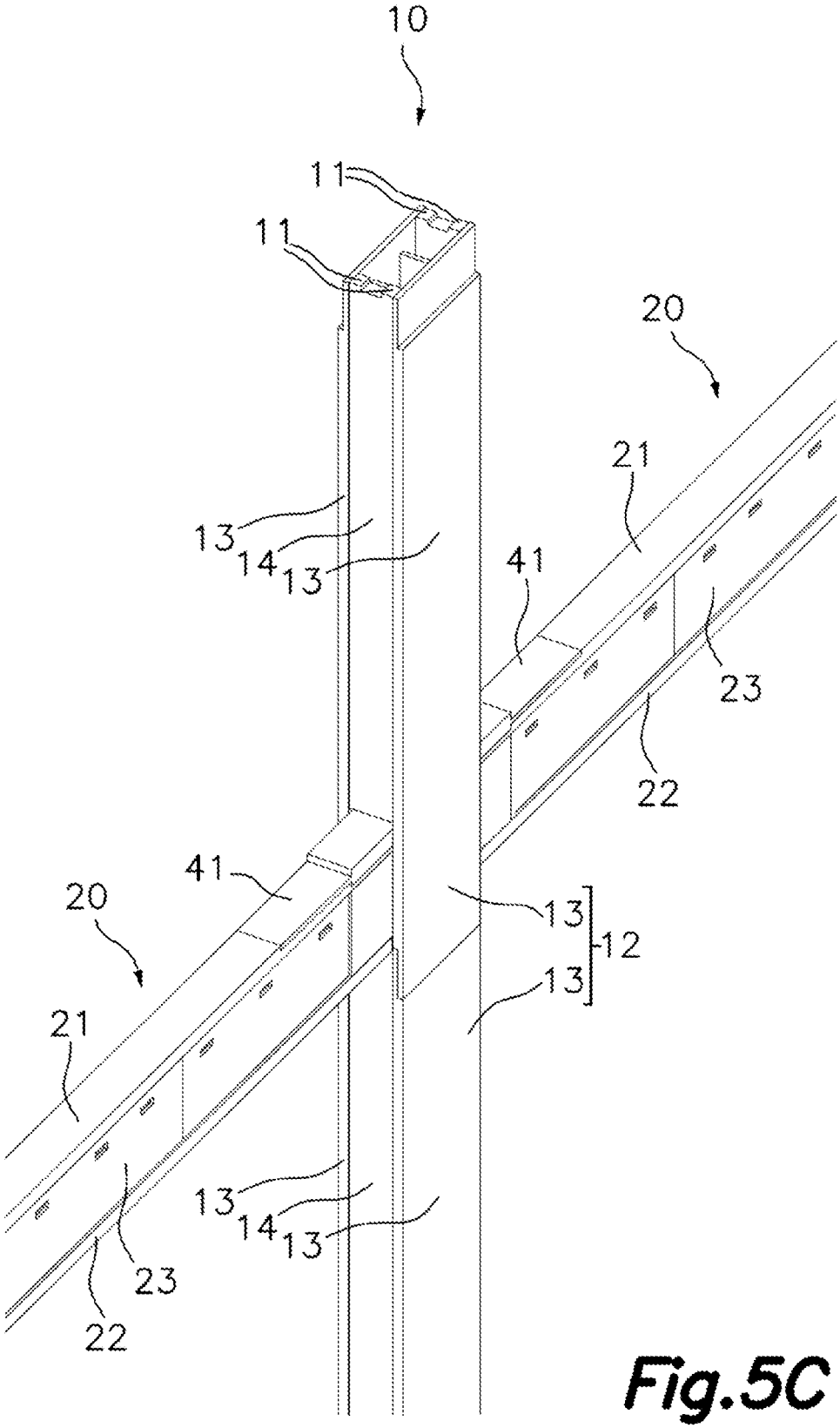
FIG. 5*c* shows the node shown on FIGS. 5*a* and 5*b* completely assembled where the two consecutive vertical structural element segments have respective vertical strut segments adhered to each other producing a continuous vertical structural element.

According to the embodiment shown in FIGS. 5*b* and 5*c* two successive vertical strut segments 13 constitutive of the same strut 12 include complementary recessed staggered steps on its ends which are coupled and adhered to each other providing a vertical continuity and a vertical transmission of loads.

According to an alternative embodiment, shown in FIG. 7*a* to 8*b*, two successive vertical strut segments 13 constitutive of the same strut 12 are connected to each other through the vertical connector 60 adhered to the vertical pillar surface 10*a* of the vertical strut segments 13 placed below the beam 20 and to the vertical pillar surface 10*a* of the vertical strut segments 13 placed above the beam 20.

Preferably each of said vertical strut segments 13 is connected to the vertical connector 60 through complementary recessed staggered steps parallel to the vertical pillar surface 10*a* included in the vertical strut segments 13 and in the vertical connector 60, to provide a distributed load transmission. Said complementary recessed staggered steps provide a vertical continuity and a vertical transmission of loads.

In some cases, it is preferred to connect vertical strut segments 13 having different cross sectional area, typically having the lower vertical strut segments 13 bigger cross sectional area to withstand bigger accumulated loads, producing a vertical structural element 10 with an increasing section and an increasing resistance.

Figure 7A:
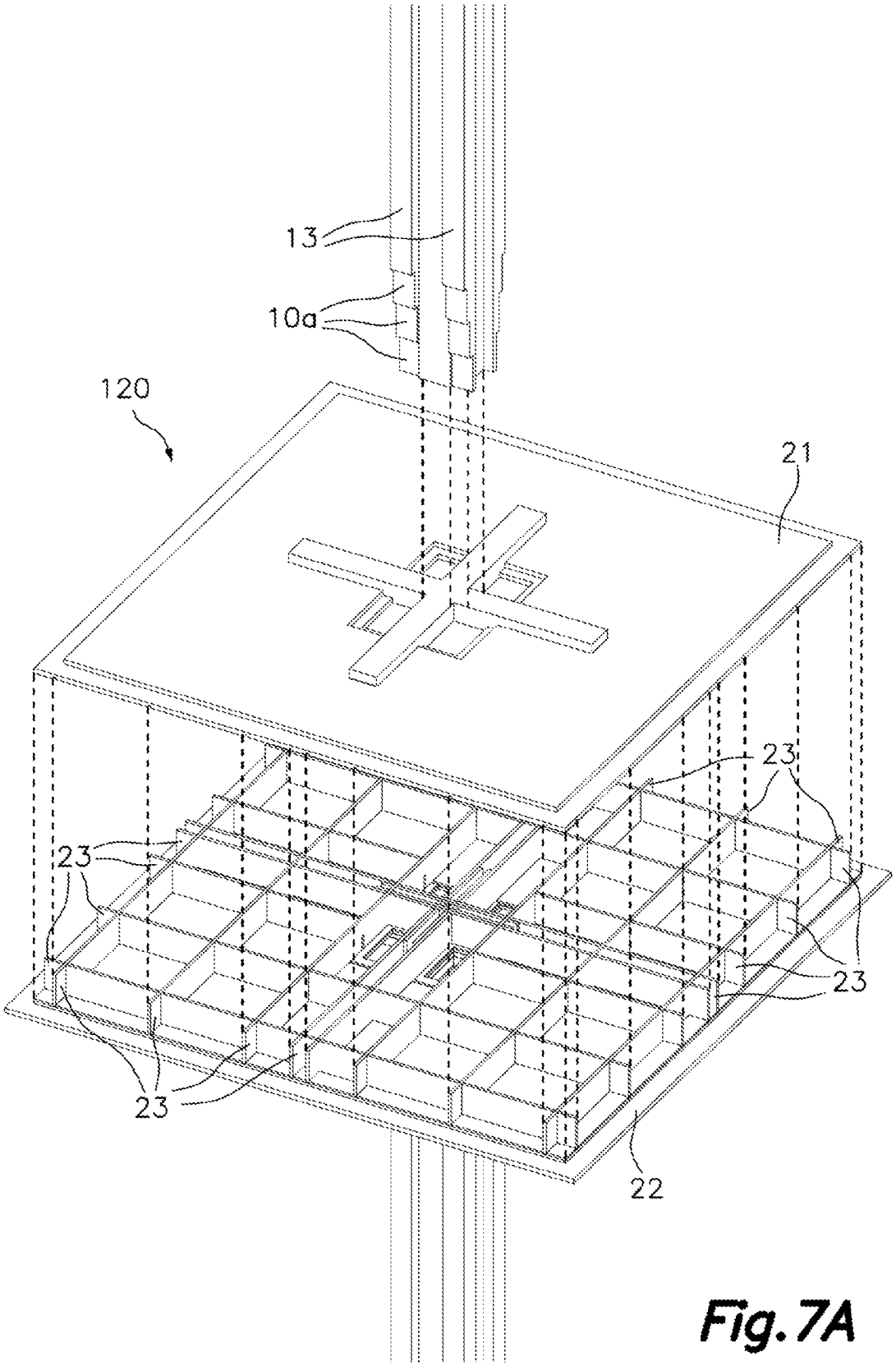
FIG. 7A shows a perspective view of an assembly step of a node of the structural system where one slab including a lower horizontal board, an upper horizontal board and second spacers defined by crossed ribs, the slab including four vertical through holes on its center and being connected to one vertical structural element segment which includes four vertical strut segments, one on each vertical through hole, and four first seats.
Figure 7B:
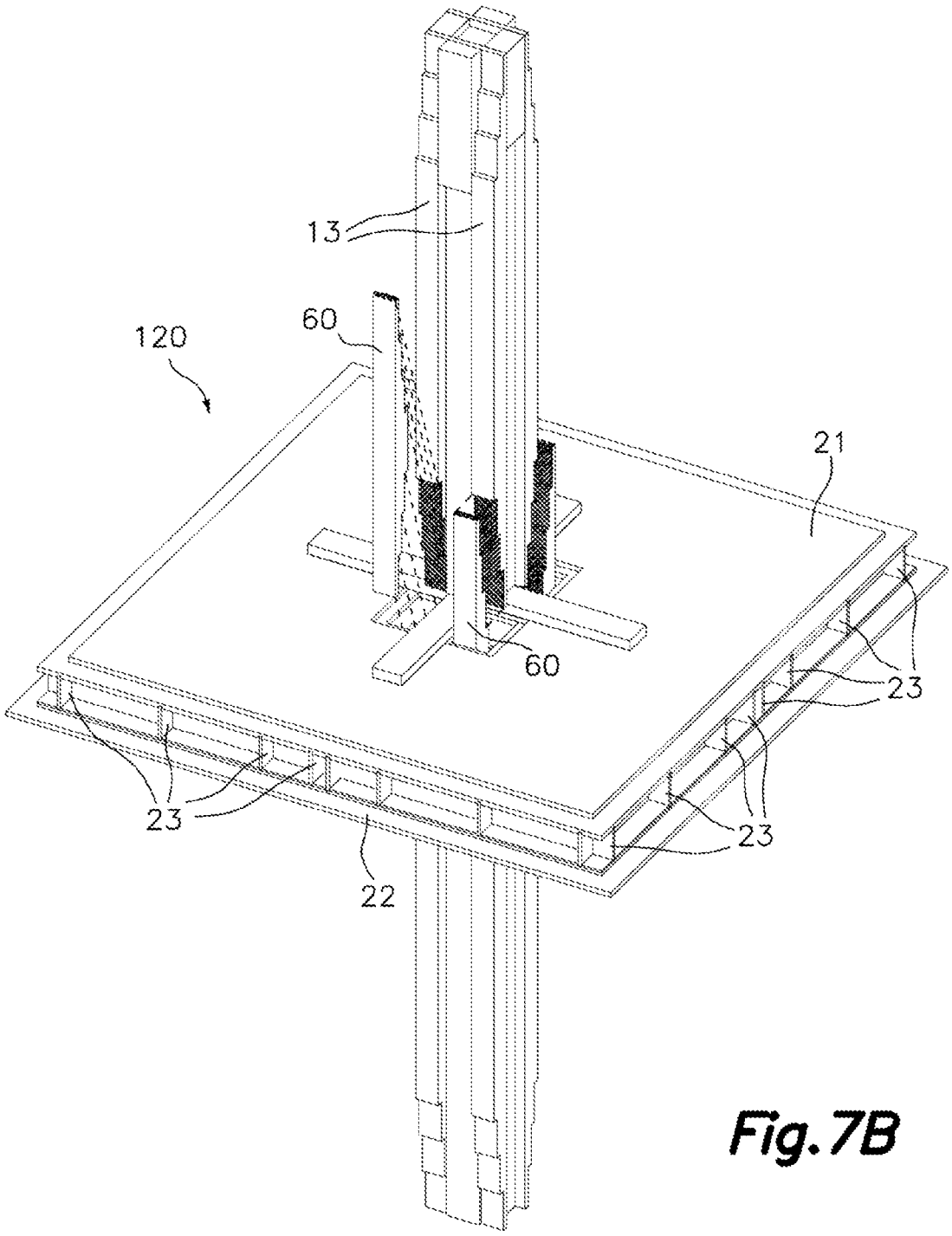
FIG. 7B shows the node shown on FIG. 7A completely assembled where the two consecutive vertical structural element segments have respective vertical strut segments adhered to each other though said vertical connectors producing a continuous vertical structural element.

All the embodiments described in regard to the connection between one or several beams 20 and one structural node of one vertical structural element 10 are also applicable to a connection between one or several slabs 120 and the structural node of the vertical structural element 10, for example, as shown in FIGS. 7A and 7B.

In those examples, the slab 120 include in its central region as many squared vertical through holes as vertical struts has the vertical structural element where it is supported, four in this example, defining a branched portion between the through holes which is housed in the hollow interior of the vertical structural element. As will be obvious, when several slabs 120 are supported on the same structural node, the number of vertical through holes on each slab 120 is only a portion of the total number of vertical struts of the vertical structural element on which are supported and said through holes will be then adjacent to an edge or to a corner of the slab 120.

In the example shown in FIGS. 7A and 7B the second spacers 23 of the slab 120 are an array of crossed ribs and the second seat include a region of said second spacers more densely populated. In this example also the upper board of the horizontal structural element include a reinforcement defined by a thickened portion of the upper board, coincident with the branched portion defined between the vertical through holes, for improving the horizontal resistance of the upper board in said region.

Between the frame defined between four orthogonal beams 20 of the same structural floor level is covered by a slab segment 30 supported on said beams 20.

Each slab segment 30 include an upper horizontal board 33, a lower horizontal board 34 parallel to each other and connected to each other through first ribs 31 parallel to each other and second ribs 32 perpendicular to the first ribs 31 interposed between said upper and lower horizontal boards 33 and 34.

The upper horizontal board 33 is bigger than the foot-print of the hollow space defined between said beams 20 where the slab segment 30 is supported. The upper horizontal board 33 include a perimetral zone supported on and adhered to the upper horizontal boards 21 of said beams 20.

Figure 1C:
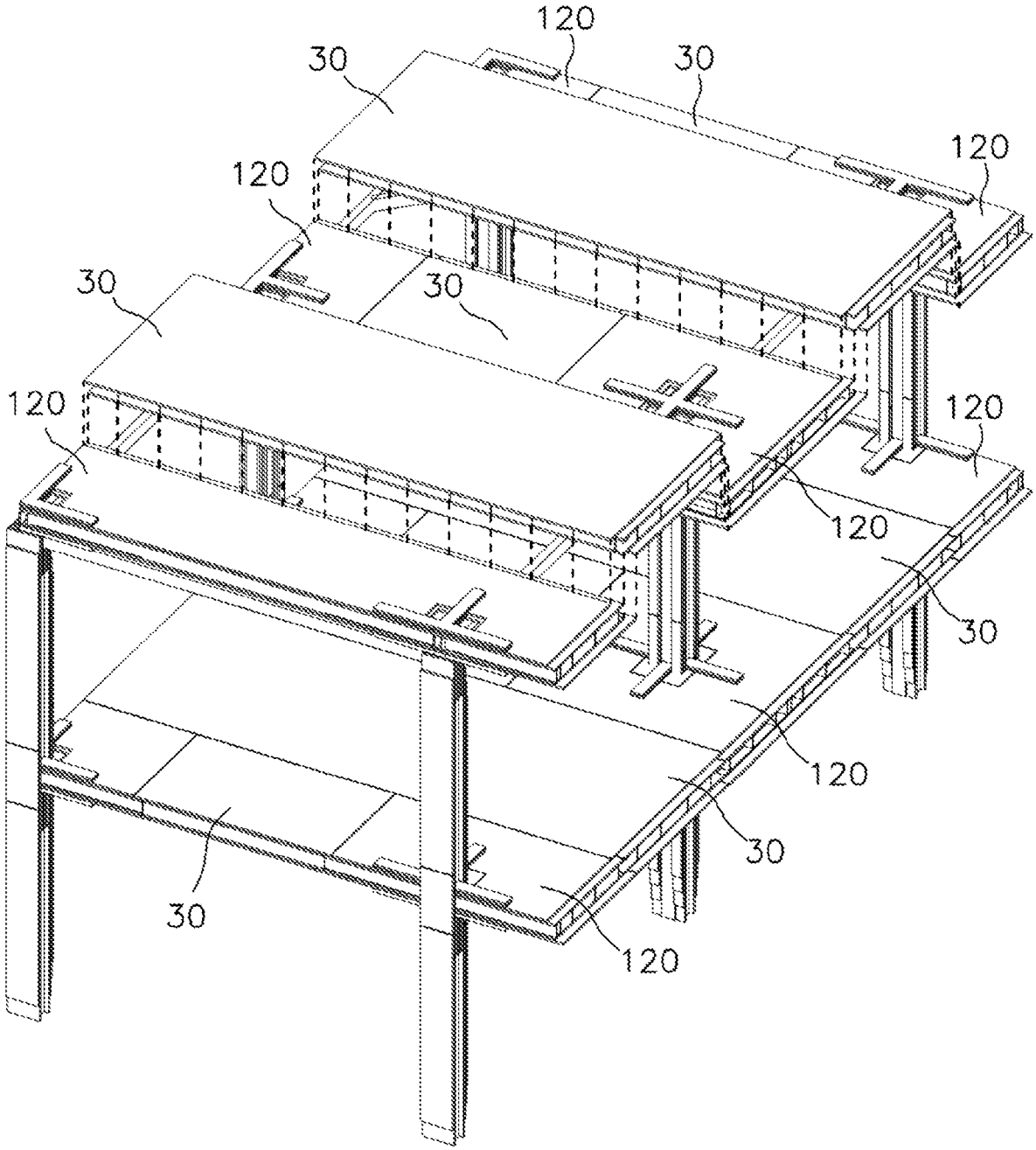
FIG. 1C shows a perspective view of a building under construction using the present engineered wood structural system, according to an embodiment in which the horizontal structural elements are slabs, each connected to one or two structural nodes, and including slab segments placed between, and supported to, said slabs defining a floor level.

The upper horizontal board 33 is connected to the upper horizontal board 33 of adjacent slab segments 30, for example through complementary recessed staggered steps provided in the perimetral zone of the upper horizontal boards 33 of both upper horizontal boards 33 of adjacent slab segments 30 connected to each other or through upper sheet connectors 36 adhered to the perimetral zone of the upper horizontal boards 33 of both upper horizontal boards 33 of adjacent slab segments 30 connected to each other. In this case the upper sheet connectors 36 are elongated slats connecting the perimetral zone of both upper horizontal boards 33, preferably said elongated slats being inserted in recessed areas of said perimetral zone and being flush with the upper horizontal boards 33, as shown in FIG. 1.

The lower horizontal board 34 is equal or smaller than the foot-print of the hollow space defined between said beams 20 on which the slab segment 30 is supported. Said lower horizontal board 34 include a perimetral zone adhered to the surrounding beams 20, preferably to the surrounding central vertical boards of said beams 20, through a lower sheet connector 35, which in this example is a slat adhered to the perimetral zone of the lower horizontal board 34, for example through complementary recessed staggered steps adhered to each other, and to the central vertical board.

In this embodiment the at least one central vertical board of the beam 20 are two parallel central vertical boards including a compression configuration in between to transmit loads from between the lower sheet connectors 35 of two different slab segments adhered on both sides of the same beam 20. In this example, the compression configuration is a transversal rib interposed between the two parallel central vertical boards, perpendicular to said two central vertical boards and parallel to, and preferably coplanar with, the lower horizontal boards 34 both adjacent slab segments 30.

The proposed slab segment 30 can be divided in three adjacent and coplanar slab segments 30*a*, 30*b* and 30*b*, each having approximately one third of the total surface of the slab segment 30, each slab segment 30*a*, 30*b* and 30*c* including a portion of the upper horizontal board 33, a portion of the lower horizontal board 34, a number of first ribs 31 and a portion of all the second ribs 32, said three slab segments 30*a*, 30*b* and 30*c* being connected to each other through slab joints.

Each slab joint includes an upper sheet joint, a lower sheet joint and a second rib joint for each single second rib 32.

The upper sheet joint comprises an upper sheet joint connector 37 adhered to two adjacent portions of the upper horizontal board 33 in a connection area adjacent to an edge between two adjacent slab segments 30*a*, 30*b*, 30*c* connected to each other, for example through complementary recessed staggered steps provided in the upper sheet joint connector 37 and in the connection area of the adjacent upper horizontal board, said complementary recessed staggered steps being coupled and adhered to each other.

The lower sheet joint comprises complementary recessed staggered steps provided on two adjacent portions of the lower horizontal board 34 in a connection area adjacent to an edge between two adjacent slab segments 30*a*, 30*b*, 30*c* connected to each other, said complementary recessed staggered steps being coupled and adhered to each other.

Alternatively, said lower sheet joint comprises a lower sheet connector adhered to two adjacent portions of the lower horizontal board 34 in a connection area adjacent to an edge between two adjacent slab segments 30*a*, 30*b*, 30*c* connected to each other.

Each second rib joint comprises complementary recessed staggered steps provided on two adjacent portions of the second rib 32 in a connection area adjacent to an edge between two adjacent slab segments 30*a*, 30*b*, 30*c* connected to each other, said complementary recessed staggered steps being coupled and adhered to each other.

Alternatively, each second rib joint comprises a second rib connector 39, in this case a small flat piece made of engineered wood adhered to two adjacent portions of the second rib 32 in a connection area adjacent to an edge between two adjacent slab segments 30*a*, 30*b*, 30*c* connected to each other, providing structural continuity between the portions of the second rib 32 connected through it.

Typically, the three slab segments 30*a*, 30*b* and 30*c* are installed adjacent to each other, supporting said slab segments 30*a*, 30*b* and 30*c* on the surrounding beams 20 through the perimetral zone of the upper horizontal board 33 and respective lower horizontal board portions are connected to each other through the lower sheet joints. Then the portions of the second ribs 32 of the different slab segments 30*a*, 30*b* and 30*c* are connected to each other by the second rib joints. Finally, the upper horizontal board portions are connected to each other by the upper sheet joint connectors 37 adhered thereto.

According to an additional embodiment, each slab segment 30 is a post-stressed slab segment includes several slab post-stressed cables 73 parallel to the first ribs 31, each slab post-stressed cable 73 extending across the slab segment 30 in tension and having opposed ends adjacent to the perimetral zone of the upper horizontal board 33 and having a central region adjacent to the lower horizontal board 34 of the slab segment 30, providing an increase in the overall structural resistance of the slab segment 30.

Optionally the slab segment further comprises several slab post-stressed cables 73 parallel to the second ribs 32, providing a bidirectional post-tensioning of the slab segment 30.

When multiple consecutive slab segments 30 are post-stressed slab segments, at least some of the slab post-stressed cables 73 can be continuous along all said consecutive slab segments 30. In that case, the slab post-stressed cables 73 pass from one slab segment 30 to the adjacent one above the beam 20 interposed between said adjacent slab segments 30.

It is also contemplated that said slab post-stressed cables 73 are inserted in slab cable sleeves, each slab segment 30 including one slab cable sleeve for each slab post-stressed cable 73 reproducing its path, the slab cable sleeves of the adjacent slab segments 30 being connected to each other through sleeve connectors placed above the beams 20 interposed between the adjacent slab segments 30. In that manner the slab cable sleeves can be installed in the slab segments before the installation of said slab segments 30 within the structural system, and later connected to each other through the sleeve connectors once in place.

Figure 3A:
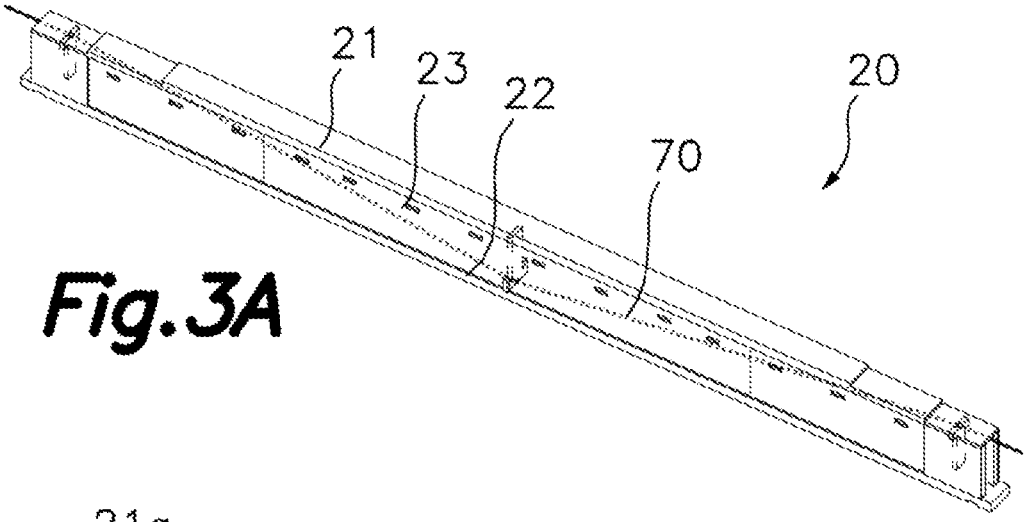
FIG. 3*a* shows an alternative embodiment of the beam shown on FIG. 2*a* including a post-stressed cable comprised between the two parallel central vertical boards.
Figure 3B:
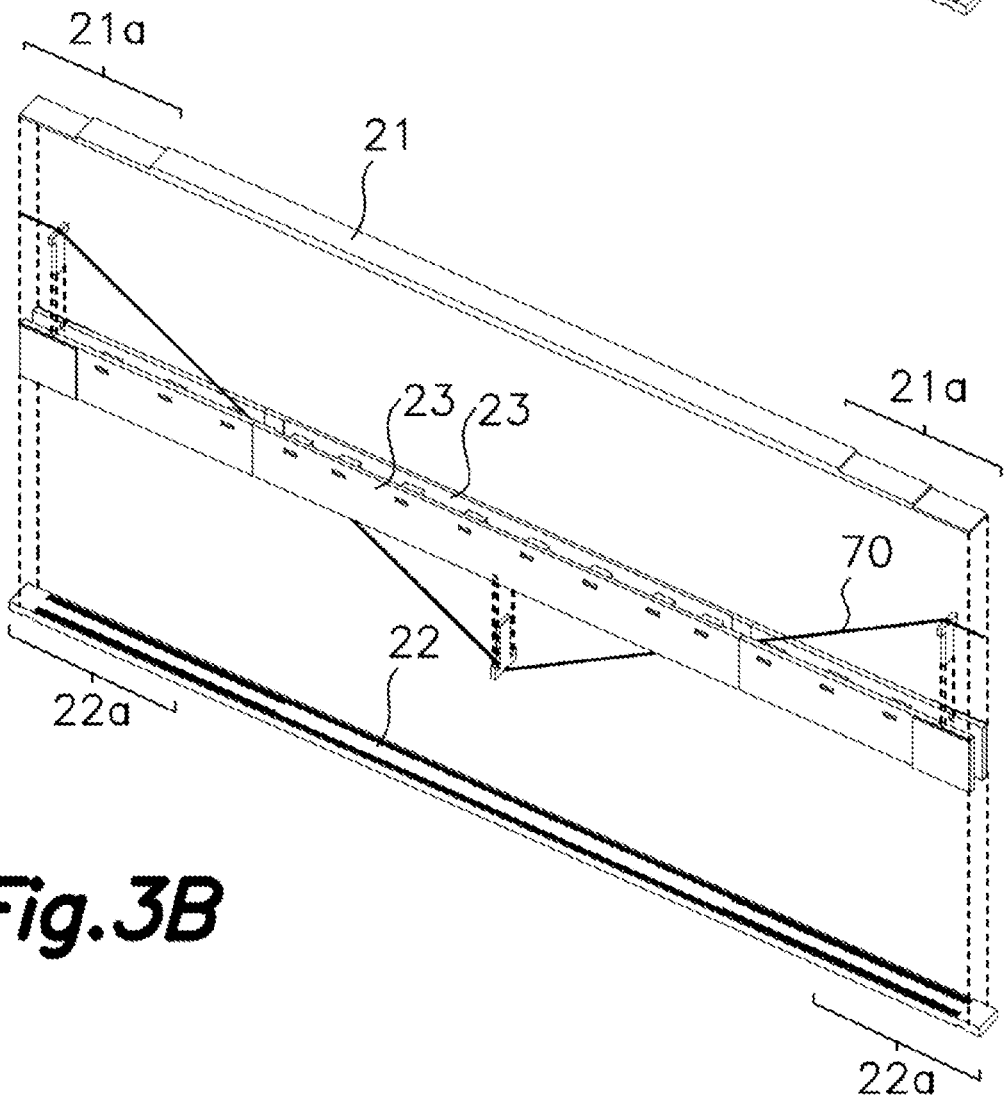
FIG. 3*b* is an exploded view of FIG. 3*a;*

In a similar manner, each beam 20 can be a post-stressed beam including at least one post-stressed cable 70 between the two opposed ends thereof, the opposed ends of said at least one beam 20 retaining the at least one post-stressed cable 70 in an upper position adjacent to the upper horizontal board 21 and a central region of said at least one beam 20, placed between said opposed ends, retaining the at least one post-stressed cable 70 in a lower position adjacent to the lower horizontal board 22. In the example shown on FIGS. 3*a* and 3*b* the post-stressed cable 70 is placed between two parallel central vertical boards, and the beam 20 includes three cable retainers interposed to, and perpendicular to, said two parallel central vertical boards. One cable retainer is in the center of the beam, retaining the post-stressed cable 70 on its lower end, and two cable retainers are in the opposed ends of the beam each retaining the post-stressed cable 70 on their respective upper ends, defining a V-shaped post-stressed cable 70.

Also, multiple consecutive beams 20 can including at least one continuous post-stressed cable 70 passing along all said consecutive beams 20. Optionally said continuous pre-stressed cable 70 can be inserted in one cable sleeve pre-installed on each beam 20, the cable sleeves of all said consecutive beams 20 being connected to each other through sleeve connectors.

It will be understood that various parts of one embodiment of the invention can be freely combined with parts described in other embodiments, even being said combination not explicitly described, provided there is no harm in such combination.

It will be understood that various parts of one embodiment of the invention can be freely combined with parts described in other embodiments, even being said combination not explicitly described, provided that such combination is within the scope of the claims and that there is no harm in such combination.

Different sub-elements constitutive of the proposed engineered wood structural system can be separately produced in a factory, transported to the building site, and later assembled together and attached using adhesives to obtain the structure.

The cited sub-elements constitutive of the proposed system can include, for example, the horizontal structural elements, the slab segments and vertical structural element segments corresponding to portions of a vertical structural element 10, each vertical structural element segment including at least one structural node, the upper connectors and the lower connectors.

The invention claimed is:

1. An engineered wood structural system made of engineered wood components, the system comprising:

at least one vertical structural element with several structural nodes located on different vertical positions, corresponding to different floor levels;

multiple horizontal structural elements, each horizontal structural element comprised of an upper horizontal board and a lower horizontal board facing each other, separated to each other in a vertical direction and rigidly connected to each other through spacers positioned between said upper and lower horizontal boards;

wherein the multiple horizontal structural elements of a same floor level are comprised of laterally adjacent slabs connected to each other through a perimetral region of the upper horizontal board of a first said laterally adjacent slab adhered to a perimetral region of the upper horizontal board of a second said laterally adjacent slab such that the upper horizontal boards of the laterally adjacent slabs are directly connected to one another, through complementary staggered steps or through a joint connector adhered on the perimetral regions of the upper horizontal boards connected to each other, to transfer horizontal loads between the upper horizontal boards of adjacent said horizontal structural elements.

2. The engineered wood structural system according to claim 1, wherein the multiple horizontal structural elements of the same floor level are laterally adjacent slabs and are connected to each other also through a perimetral region of the lower horizontal board of one of said laterally adjacent slabs attached to a perimetral region of the lower horizontal board of the other laterally adjacent slab to transfer horizontal loads.

3. The engineered wood structural system according to claim 1, wherein:

the slabs are post-stressed slabs including multiple slab post-stressed cables parallel to each other or disposed in two crossed directions; or the slabs are multiple aligned consecutive post-stressed slabs including multiple continuous slab post-stressed cables parallel to each other or disposed in two crossed directions, one or multiple of said slab post-stressed cables passing along all said consecutive slabs.

4. The engineered wood structural system according to claim 1, wherein the spacers include at least one of:

one or several central vertical boards or several central vertical boards arranged in orthogonal directions, a rigid foam rigidly connecting the upper and lower horizontal boards, several piled horizontal boards, several piled horizontal boards with oriented fibers parallel to each other, or several piled horizontal boards with oriented fibers distributed in perpendicular directions in successive board.

5. The engineered wood structural system according to claim 1, wherein the engineered wood elements connected to each other have a tolerance gap between them filled with hardened adhesive, or a tolerance gap of up to 25 mm (0.984 in) between the engineered wood elements connected to each other filled with hardened adhesive when no shear loads are transmitted through said hardened adhesive, or a tolerance gap of up to 1 mm (0.039 in) between the engineered wood elements connected to each other filled with hardened adhesive when shear loads are transmitted through said hardened adhesive.

6. The engineered wood structural system according to claim 1, wherein the horizontal structural elements of the same floor level are spaced apart by a gap distance and the gap distance is covered by one or several slab segments supported on the horizontal structural elements surrounding said gap distance, each slab segment including an upper horizontal board and a lower horizontal board facing each other, separated to each other in a vertical direction and rigidly connected to each other through additional spacers comprised between the upper and lower horizontal boards of a respective said slab segment.

7. The engineered wood structural system according to claim 6, wherein a perimetral region of the upper horizontal board of the respective slab segment is adhered to at least one of the upper horizontal board of surrounding said horizontal structural elements or to the upper horizontal board of an adjacent slab segment, the adhesion being produced directly, through complementary staggered steps or through a joint connector adhered to two adjacent portions of the upper horizontal board in a connection area adjacent to an edge between two adjacent slab segments connected to each other to transfer horizontal traction loads.

8. The engineered wood structural system according to claim 7, wherein a perimetral region of the lower horizontal board of the respective slab segment is attached to a perimetral region of at least one of the lower horizontal board of the surrounding horizontal structural elements or to the lower horizontal board of an adjacent slab segment, directly, through complementary staggered steps or through an interposed connector adhered to a perimetral zone of the lower horizontal board, to transfer horizontal compression loads.

9. The engineered wood structural system according to claim 1, wherein the vertical structural element includes, on each structural node, at least one first seat and wherein at least one horizontal structural element supported on each structural node includes at least one second seat supported and vertically overlapped on the at least one first seat of the vertical structural element.

10. The engineered wood structural system according to claim 9, wherein the second seat is at least one of:

a region, or a reinforced region, of the lower horizontal board, or a portion, or a reinforced portion, of the spacers non-covered by the lower horizontal board, or a portion, or a reinforced portion, of the upper board extended in cantilever from rest of the horizontal structural elements, and wherein the second seat is supported on the first seat directly or through an interposed element or an engineered wood, metal or plastic interposed element.

11. The engineered wood structural system according to claim 9, wherein, in at least one said structural node the upper and lower horizontal boards of at least one said horizontal structural element connected to said at least one structural node are separated from the vertical structural element by a gap distance, and the first and second seats are configured to reduce or avoid transmission of bending forces, defining an articulated joint between at least one horizontal structural element and the vertical structural element.

12. The engineered wood structural system according to claim 9, wherein, in at least one said structural node the upper and lower horizontal boards, of at least one said horizontal structural element connected to said at least one structural node, are respectively in direct contact or connected through hardened adhesives to opposed vertical sides of the vertical structural element, transmitting bending forces to the vertical structural element defining a rigid joint between the at least one horizontal structural element and the vertical structural element.

* * * * *